US010331077B2

(12) United States Patent
Kusano et al.

(10) Patent No.: US 10,331,077 B2
(45) Date of Patent: Jun. 25, 2019

(54) CARTRIDGE WHERE BIASING MEMBER IS RELIABLY HELD ON COUPLING MEMBER

(71) Applicant: CANON KABUSHIKI KAISHA, Tokyo (JP)

(72) Inventors: Yohei Kusano, Numazu (JP); Takuya Kawakami, Mishima (JP); Takatoshi Hamada, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/830,267

(22) Filed: Dec. 4, 2017

(65) Prior Publication Data

US 2018/0164741 A1 Jun. 14, 2018

(30) Foreign Application Priority Data

Dec. 12, 2016 (JP) ..... 2016-240657

(51) Int. Cl.
*G03G 21/18* (2006.01)
*G03G 15/16* (2006.01)

(52) U.S. Cl.
CPC ..... *G03G 21/1842* (2013.01); *G03G 21/1864* (2013.01); *G03G 21/18* (2013.01)

(58) Field of Classification Search
CPC ..... G03G 21/1842
USPC ..... 399/111
See application file for complete search history.

(56) References Cited

U.S. PATENT DOCUMENTS 9,657,608 B2 5/2017 Sugano et al.
2012/0243905 A1* 9/2012 Uratani ..... G03G 21/1853 399/111
2014/0270845 A1* 9/2014 Kawakami ..... G03G 21/186 399/110
2016/0246250 A1 8/2016 Kamoshida et al.

FOREIGN PATENT DOCUMENTS

JP 2004231401 A 8/2004
JP 2014137051 A 7/2014
JP 2015079243 A 4/2015

* cited by examiner

*Primary Examiner* — Susan S Lee
(74) *Attorney, Agent, or Firm* — Rossi, Kimms & McDowell LLP

(57) ABSTRACT

A cartridge that can be mounted in and detached from main body of an apparatus of an image forming apparatus includes: a rotating member that rotates upon reception of driving force from main body of the apparatus; a coupling member that includes a force receiving portion for receiving the driving force from main body of the apparatus via a drive shaft, transmits the driving force to the rotating member by rotating, and is capable of moving relative to the rotating member; and a wire-shaped biasing member for biasing the coupling member, wherein the coupling member includes a groove that is contacted by the biasing member, and an opening width of the groove is wider than a wire diameter of the biasing member.

23 Claims, 23 Drawing Sheets

Z SECTIONAL VIEW

X SECTIONAL VIEW

Y SECTIONAL VIEW

CARTRIDGE WHERE BIASING MEMBER IS RELIABLY HELD ON COUPLING MEMBER

BACKGROUND OF THE INVENTION

Field of the Invention

The present invention relates to a cartridge and an image forming apparatus that uses the cartridge.

Description of the Related Art

In a conventional cartridge-system image forming apparatus, driving force is transmitted from main body of an image forming apparatus in order to rotate a rotating member such as an electrophotographic photosensitive member (referred to hereafter as a photosensitive drum) that is provided in a cartridge and typically formed in the shape of a drum. In a conventional configuration for realizing this system, a coupling member provided on the cartridge side is engaged to a drive transmission portion provided on main body of the image forming apparatus side. Here, depending on the image forming apparatus, the cartridge may be configured to be detachable in a predetermined direction that is substantially orthogonal to a rotational axis of the photosensitive drum. In another known configuration, a mechanism for moving the drive transmission portion of main body of the image forming apparatus in a rotational axis direction in response to an opening/closing operation of main body of the image forming apparatus is not provided. More specifically, a configuration in which a coupling member provided on an end of the photosensitive drum can be tilted relative to the rotational axis of the photosensitive drum has been disclosed. Further, a biasing member is provided on the cartridge in order to tilt the coupling member. In Japanese Patent Application Publication No. 2015-79243, a groove formed in an annular shape so as to extend in a circumferential direction is provided in a conical portion of a coupling member in order to limit a position of a biasing member relative to the coupling member.

An object of the present invention is to develop the prior art described above by providing a cartridge in which a biasing member can be held more reliably on a coupling member.

SUMMARY OF THE INVENTION

Another object of the present invention is to provide a cartridge described below.

A cartridge that can be mounted in and detached from main body of an apparatus of an image forming apparatus, comprising:

a rotating member that rotates upon reception of driving force from main body of the apparatus;

a coupling member that includes a force receiving portion for receiving the driving force from main body of the apparatus via a drive shaft, transmits the driving force to the rotating member by rotating, and is capable of moving relative to the rotating member; and a wire-shaped biasing member for biasing the coupling member, wherein the coupling member includes a groove that is contacted by the biasing member, and an opening width of the groove is wider than a wire diameter of the biasing member.

According to the present invention, the biasing member can be held more reliably on the coupling member.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Here, a cartridge is formed by forming a photosensitive drum and process unit for performing actions on the photosensitive drum integrally in cartridge form, and mounting the cartridge detachably in main body of an image forming apparatus. Examples of image forming apparatuses include an electrophotographic copier, an electrophotographic printer (an LED printer, a laser beam printer, or the like), a facsimile apparatus, a word processor, and so on, for example.

Figure 2:
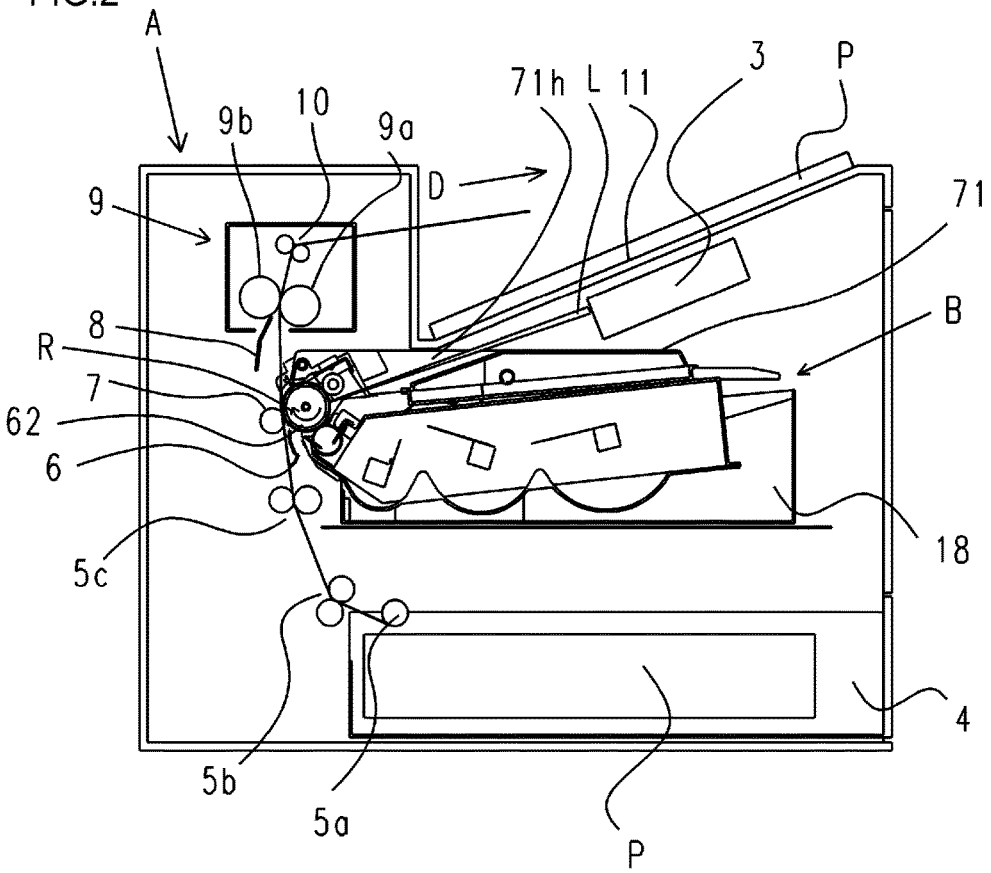
FIG. 2 is a sectional view of main body of an image forming apparatus and a cartridge according to the first embodiment.
Figure 3:
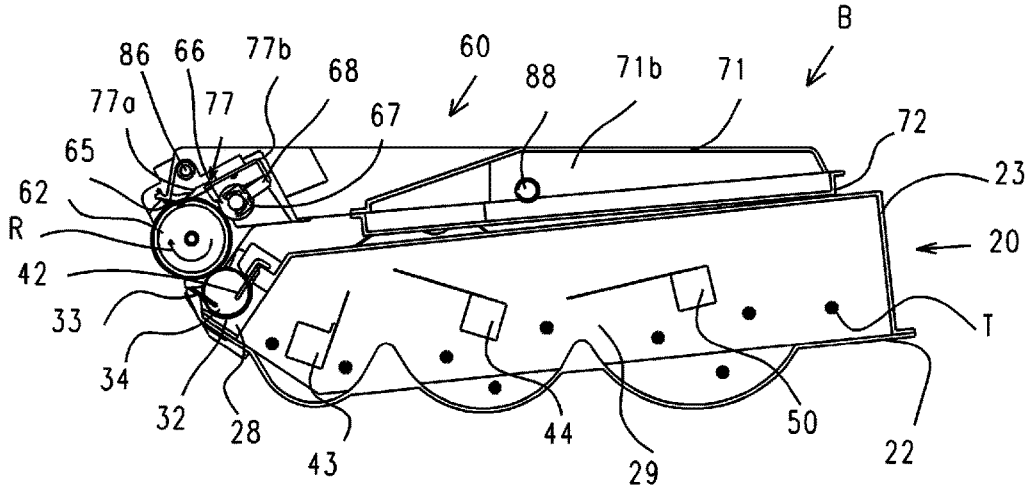
FIG. 3 is a sectional view of the cartridge according to the first embodiment.

Embodiments of the present invention will be described in detail below on the basis of the figures. Note that a rotational axis direction of a photosensitive drum is set as a longitudinal direction. Further, in the longitudinal direction, aside on which the photosensitive drum receives driving force from main body of the image forming apparatus will be referred to as a drive side, and an opposite side thereto will be referred to as a non-drive side. Using FIGS. 2 and 3, an overall configuration and an image formation process will be described. FIG. 2 is a sectional view showing main body of an image forming apparatus (referred to hereafter as main body A of an apparatus) of an image forming apparatus and a cartridge (referred to hereafter as a cartridge B) according to an embodiment of the present invention. FIG. 3 is a sectional view of the cartridge B. Here, main body A of the apparatus refers to the parts of the image forming apparatus excluding the cartridge B.

Overall Configuration of Image Forming Apparatus

The image forming apparatus shown in FIG. 2 is a laser beam printer using electrophotographic technology, in which the cartridge B can be mounted in and detached from main body A of the apparatus freely. An exposure apparatus 3 (a laser scanner unit) is disposed to form a latent image on a drum 62 serving as a photosensitive drum of the cartridge B when the cartridge B is mounted in main body A of the apparatus. Further, a sheet tray 4 housing a recording medium (referred to hereafter as a sheet material P) that serves as an image formation subject is disposed below the cartridge B. Furthermore, a pickup roller 5*a*, a pair of feed rollers 5*b*, a pair of transport rollers 5*c*, a transfer guide 6, a transfer roller 7, a transport guide 8, a fixing apparatus 9, a pair of discharge rollers 10, a discharge tray 11, and so on are disposed in main body A of the apparatus in that order in a transport direction D of the sheet material P. Note that the fixing apparatus 9 is constituted by a heat roller 9*a* and a pressure roller 9*b*.

Image Formation Process

Next, an image formation process will be described briefly using FIGS. 2 and 3. On the basis of a print start signal, the photosensitive drum (referred to hereafter as the drum 62) is driven to rotate in the direction of an arrow R at a predetermined circumferential velocity (process speed). A charging roller 66 to which a bias voltage has been applied contacts an outer peripheral surface of the drum 62 so as to charge the outer peripheral surface of the drum 62 uniformly. The exposure apparatus 3 outputs a laser beam L corresponding to image information. The laser beam L passes through a laser aperture 71*h* provided in a cleaning frame 71 of the cartridge B so as to perform scanning exposure on the outer peripheral surface of the drum 62. As a result, an electrostatic latent image corresponding to the image information is formed on the outer peripheral surface of the drum 62. Meanwhile, as shown in FIG. 3, in a developing unit 20 serving as a developing apparatus, toner T in a toner chamber 29 is agitated and transported by rotating a first transport member 43, a second transport member 44, and a third transport member 50, and thereby delivered to a toner supply chamber 28. The toner T is carried on the surface of a developing roller 32 by magnetic force from a magnet roller 34 (a fixing magnet). A developing blade 42 triboelectrically charges the toner T on the peripheral surface of the developing roller 32 while limiting a layer thickness thereof. The toner T is developed onto the drum 62 in accordance with the electrostatic latent image, and thereby visualized as a toner image.

Further, as shown in FIG. 2, the sheet material P housed in the lower portion of main body A of the apparatus is delivered from the sheet tray 4 by the pickup roller 5*a*, the pair of feed rollers 5*b*, and the pair of transport rollers 5*c* in alignment with an output timing of the laser beam L. The sheet material P passes the transfer guide 6 so as to be transported to a transfer position between the drum 62 and the transfer roller 7. In the transfer position, the toner image is transferred successively onto the sheet material P from the drum 62. The sheet material P onto which the toner image has been transferred is separated from the drum 62 and transported to the fixing apparatus 9 along the transport guide 8. The sheet material P then passes through a nip between the heat roller 9*a* and the pressure roller 9*b* constituting the fixing apparatus 9. In the nip, pressure/heat fixing processing is executed to fix the toner image on the sheet material P. The sheet material P, having been subjected to the toner image fixing processing, is then transported to the pair of discharge rollers 10 and discharged onto a discharge tray 11. Meanwhile, as shown in FIG. 3, following transfer, a cleaning member 77 removes residual toner from the outer peripheral surface of the drum 62 so that the drum 62 can be used in the next image formation process. The toner removed from the drum 62 is stored in a waste toner chamber 71*b* of a cleaning unit 60. In the above description, the charging roller 66, the developing roller 32, the transfer roller 7, and the cleaning member 77 together constitute the process unit for performing actions on the drum 62.

Cartridge Mounting/Detach Operation

Figure 5:
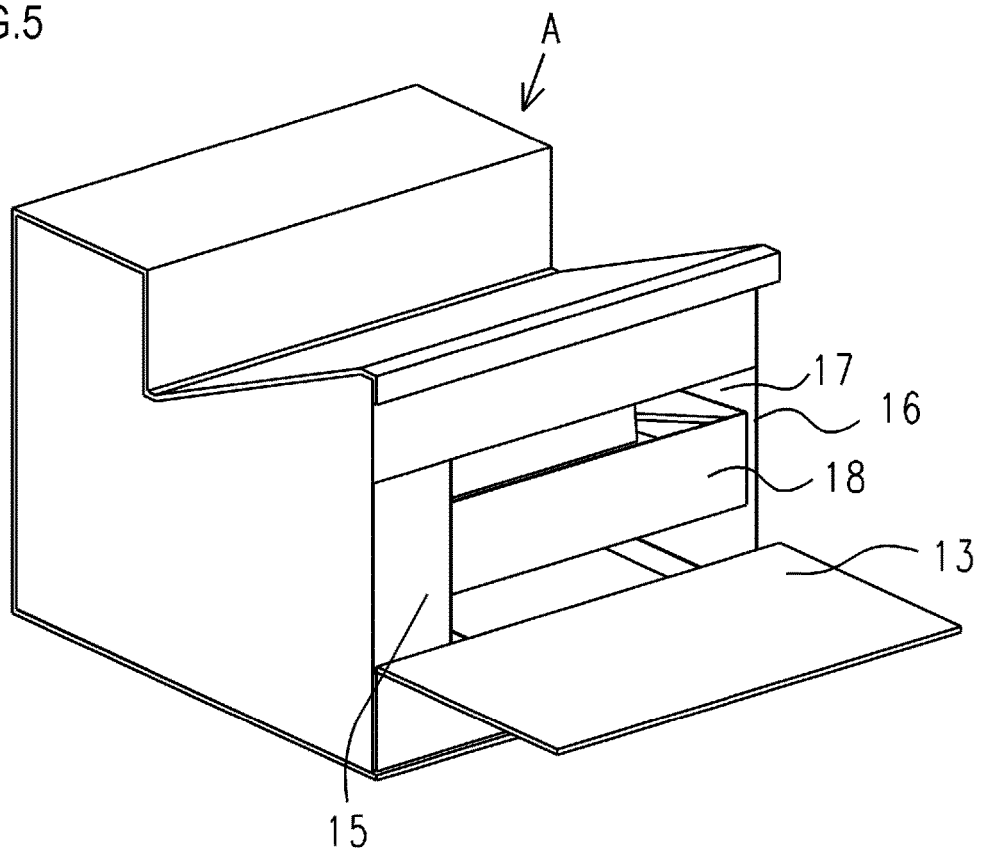
FIG. 5 is a perspective view showing main body of the image forming apparatus according to the first embodiment in a state where an opening/closing door is open.
Figure 6:
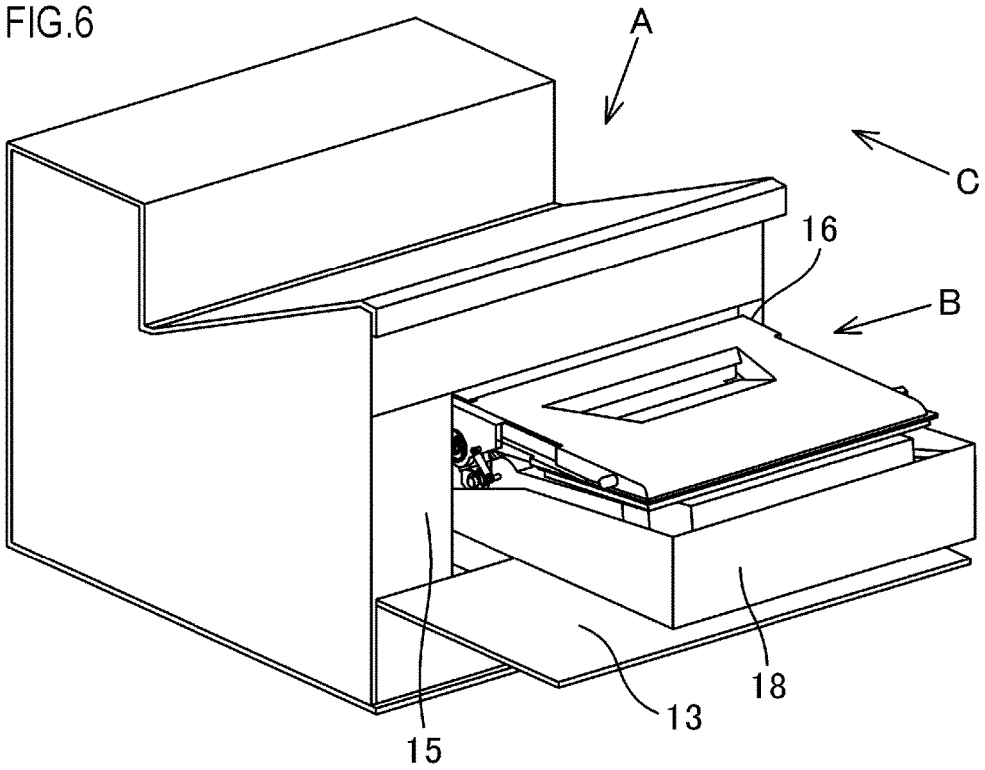
FIG. 6 is a perspective view showing main body of the image forming apparatus according to the first embodiment in a state where a tray is pulled out.
Figure 7:
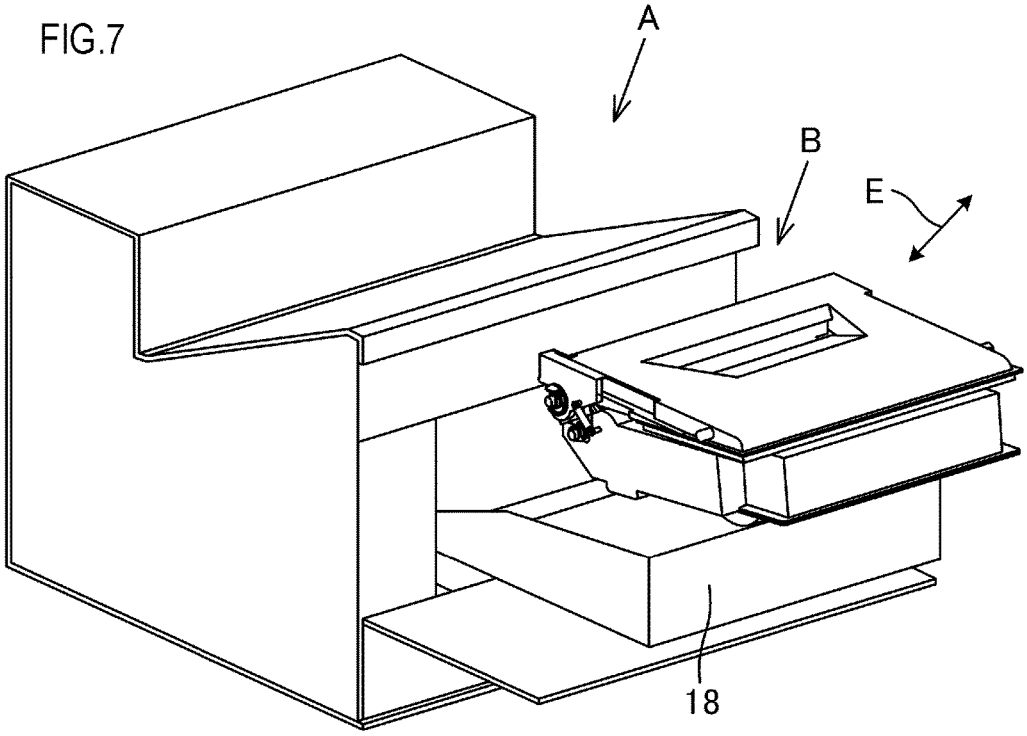
FIG. 7 is a perspective view of main body of the image forming apparatus and the cartridge according to the first embodiment.
Figure 8:
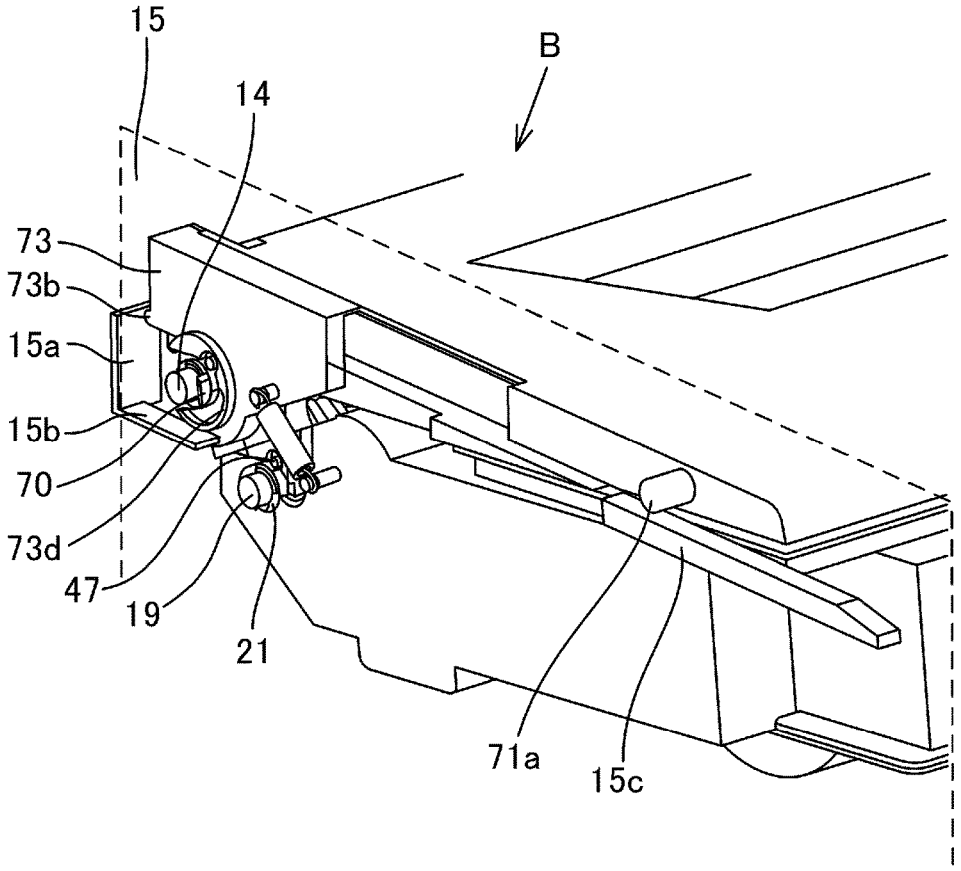
FIG. 8 is a view of the cartridge and a drive-side positioning portion of main body of the apparatus, according to the first embodiment.

Next, operations to mount and detach the cartridge B in and from main body A of the apparatus will be described using FIGS. 5 to 7. FIG. 5 is a perspective view showing main body A of the apparatus when an opening/closing door 13 for mounting and detaching the cartridge B is open. FIG. 6 is a perspective view showing main body A of the apparatus and the cartridge B when the opening/closing door 13 is open and a tray 18 is pulled out in order to mount or detach the cartridge B. FIG. 7 is a perspective view showing main body A of the apparatus and the cartridge B when the opening/closing door 13 is open, the tray 18 is pulled out, and the cartridge B is being mounted or detached. The cartridge B can be mounted in and detached from the tray 18 in a mounting/detaching direction E. The opening/closing door 13 is attached rotatably to main body A of the apparatus, and when the opening/closing door 13 is opened, a cartridge insertion port 17 is provided. The tray 18 for mounting the cartridge B in main body A of the apparatus is provided in the cartridge insertion port 17. When the tray 18 is pulled out to a predetermined position, the cartridge B can be mounted and detached. The cartridge B is mounted in main body A of the apparatus while carried on the tray 18 in the direction of an arrow C in the figure along guide rails (not shown). Further, as shown in FIG. 8, the cartridge B is provided with a first drive shaft 14 and a second drive shaft 19 for transmitting drive to a first coupling 70 and a second coupling 21. The first drive shaft 14 and the second drive shaft 19 are driven by a motor (not shown) of main body A of the apparatus. Accordingly, the drum 62, which is coupled to the first coupling 70, rotates upon reception of driving force from main body A of the apparatus. Furthermore, the developing roller 32 rotates when drive is transmitted thereto from the second coupling 21. Moreover, power is fed to the charging roller 66 and the developing roller 32 by a power feeding portion (not shown) of main body A of the apparatus.

Cartridge Support Portion

Figure 9:
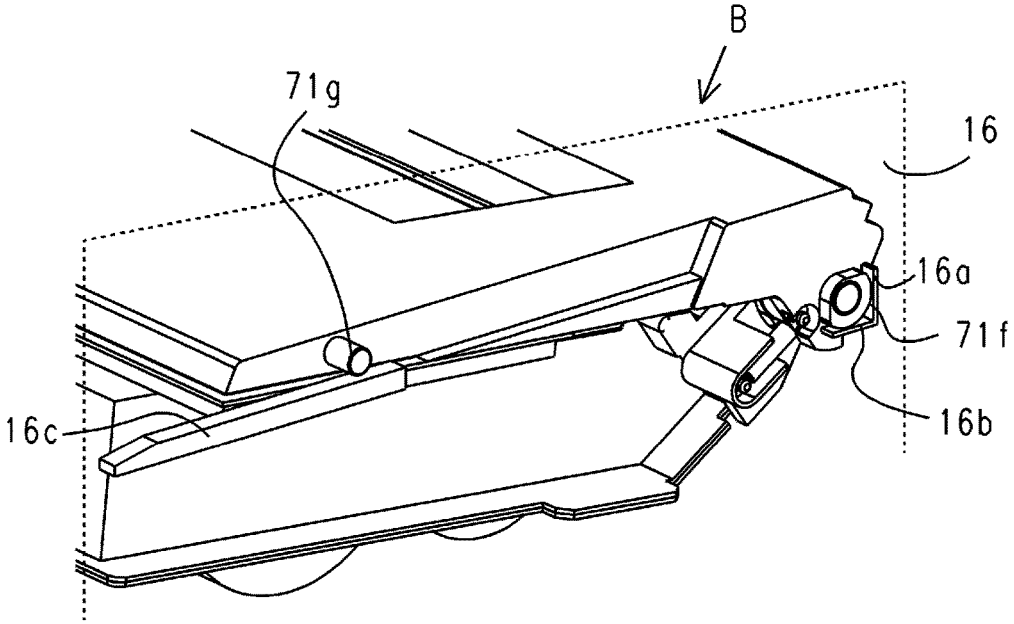
FIG. 9 is a view of the cartridge and a non-drive-side positioning portion of main body of the apparatus, according to the first embodiment.

Next, a configuration for supporting the cartridge B in main body of the apparatus will be described. As shown in FIG. 5, a drive-side plate 15 and a non-drive-side plate 16 for supporting the cartridge B are provided on main body A of the apparatus. As shown in FIG. 8, a drive-side first support portion 15*a*, a drive-side second support portion 15*b*, and a rotary support portion 15*c* for the cartridge B are provided on the drive-side plate 15. Further, as shown in FIG. 9, a non-drive-side first support portion 16*a*, a non-drive-side second support portion 16*b*, and a rotary support portion 16*c* are provided on the non-drive-side plate 16. Meanwhile, a supported portion 73*b* and a supported portion 73*d* of a drum bearing 73, and a drive-side boss 71*a*, a non-drive-side projection 71*f*, and a non-drive-side boss 71*g* of the cleaning frame 71 are respectively provided as supported portions of the cartridge B. The supported portion 73*b* and the supported portion 73*d* are supported respectively by the drive-side first support portion 15*a* and the drive-side second support portion 15*b*, while the drive-side boss 71*a* is supported by the rotary support portion 15*c*. Further, the non-drive-side projection 71*f* is supported by the non-drive-side first support portion 16*a* and the non-drive-side second support portion 16*b*, and the non-drive-side boss 71*g* is supported by the rotary support portion 16*c*. Thus, the cartridge B is positioned within main body A of the apparatus.

Overall Configuration of Cartridge

Figure 10:
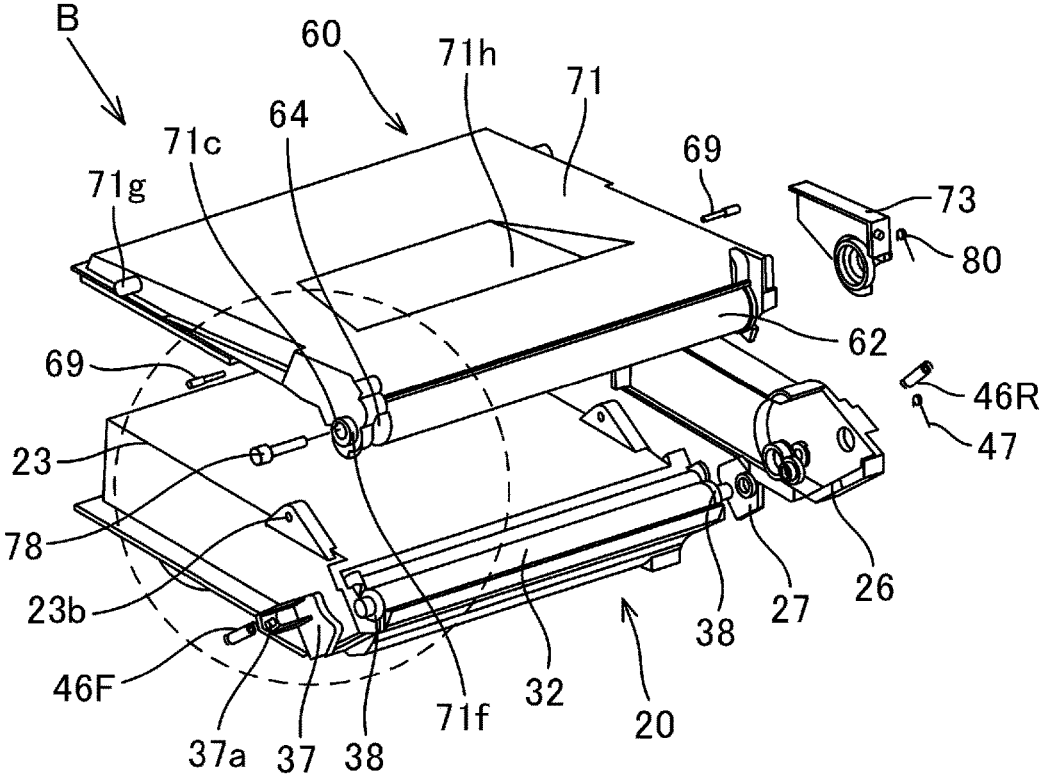
FIG. 10 is an exploded view showing the cartridge according to the first embodiment from the non-drive side.
Figure 11:
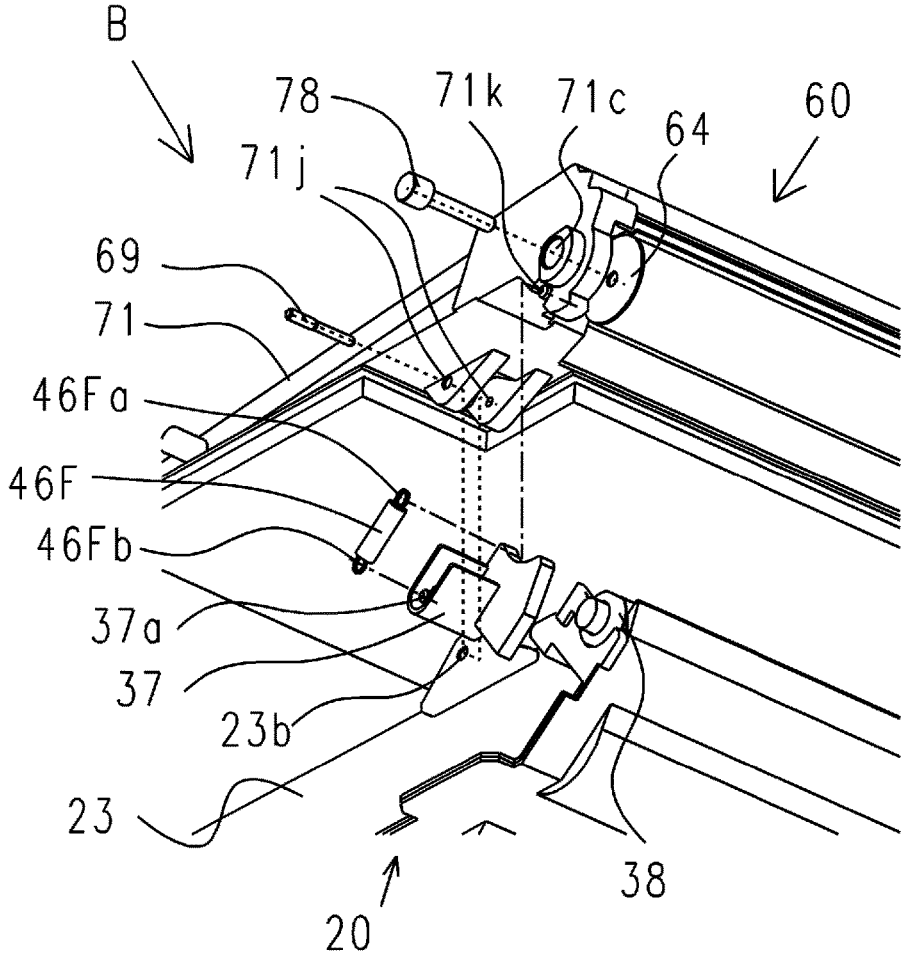
FIG. 11 is an enlarged view of a non-drive-side part of the cartridge according to the first embodiment.
Figure 12:
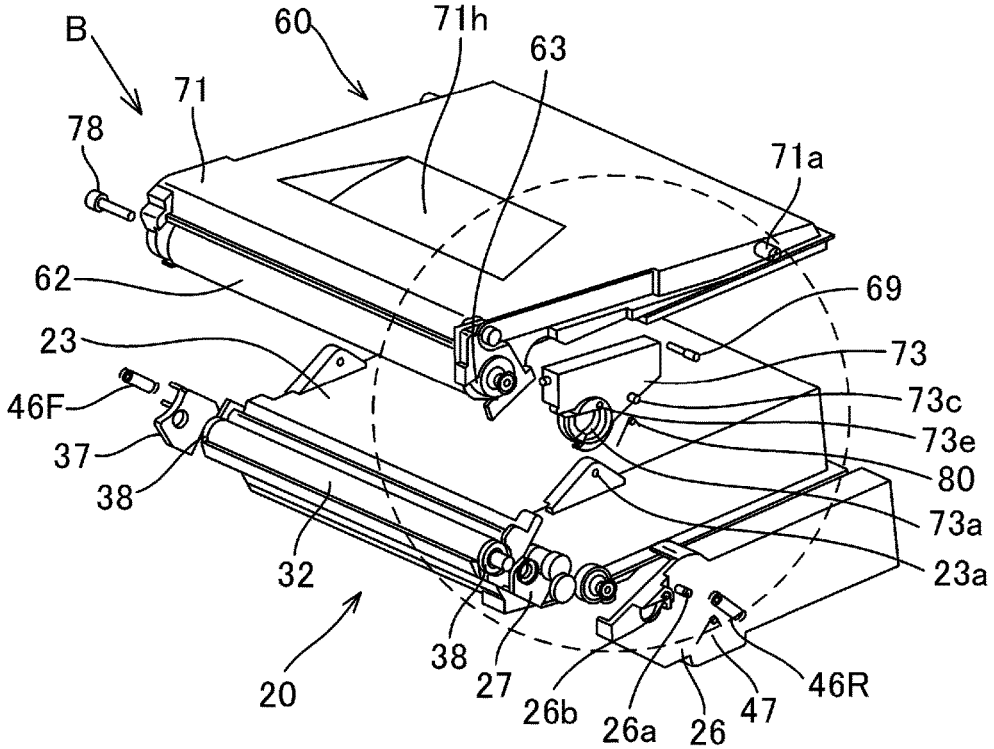
FIG. 12 is an exploded view showing the cartridge according to the first embodiment from the drive side.
Figure 13:
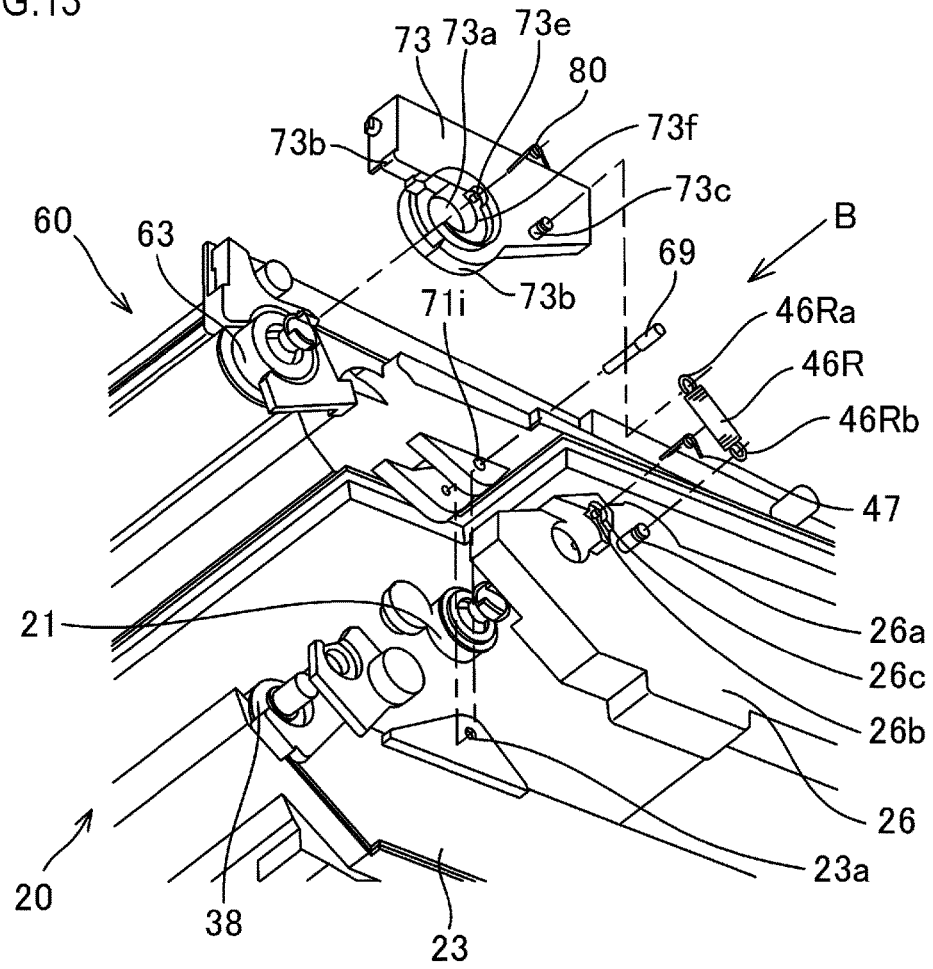
FIG. 13 is an enlarged view of a drive-side part of the cartridge according to the first embodiment.

Next, the overall configuration of the cartridge B will be described using FIGS. 3, 4, 10, 11, 12, and 13. FIG. 3 is a sectional view of the cartridge B. FIGS. 10 and 12 are perspective views illustrating the configuration of the cartridge B. FIGS. 11 and 13 are partially enlarged views obtained by varying angles of, and thereby enlarging, locations within dotted lines in FIGS. 10 and 12. Note that in this embodiment, description relating to hinges for joining the respective components has been omitted.

The cartridge B includes the cleaning unit 60 and the developing unit 20. As shown in FIG. 3, the cleaning unit 60 includes the drum 62, the charging roller 66, the cleaning member 77, the cleaning frame 71 for supporting these components, and a lid member 72 fixed to the cleaning frame 71 by welding or the like. In the cleaning unit 60, the charging roller 66 and the cleaning member 77 are both disposed in contact with the outer peripheral surface of the drum 62. The cleaning member 77 includes a rubber blade 77*a* serving as a blade-shaped elastic member formed from rubber, and a support member 77*b* for supporting the rubber blade. The rubber blade 77*a* contacts the drum 62 in a counter direction to a rotation direction of the drum 62. In other words, the rubber blade 77*a* contacts the drum 62 such that a tip end thereof is oriented toward an upstream side of the rotation direction of the drum 62.

Figure 4:
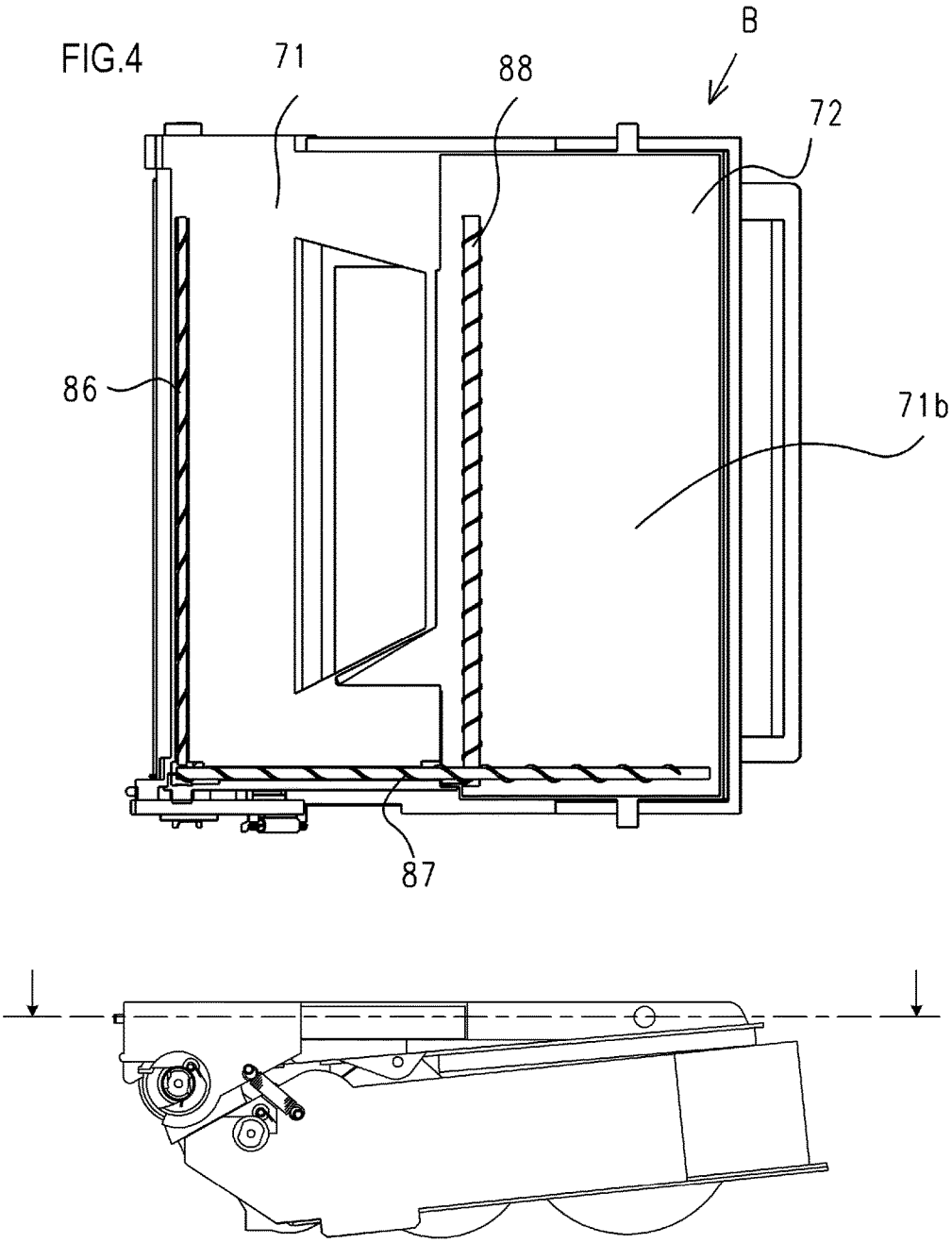
FIG. 4 is a sectional view of a cleaning container according to the first embodiment.

FIG. 4 is a sectional view of the cleaning frame 71. As shown in FIGS. 3 and 4, the waste toner removed from the surface of the drum 62 by the cleaning member 77 is transported by a first screw 86, a second screw 87, and a third screw 88 serving as waste toner transportation members, and stored in the waste toner chamber 71*b*, which is formed by the cleaning frame 71 and the lid member 72. Further, the first screw 86 rotates when driving force is transmitted thereto from the second coupling 21, shown in FIG. 13, by a gear (not shown). The second screw 87 and the third screw 88 rotate upon reception of driving force from the first screw 86 and the second screw 87, respectively. The first screw 86, the second screw 87, and the third screw 88 are respectively disposed in the vicinity of the drum 62, on a longitudinal direction end of the cleaning frame 71, and in the waste toner chamber 71*b*. Here, respective rotational axes of the first screw 86 and the third screw 88 are parallel to the rotational axis of the drum 62, while a rotational axis of the second screw 87 is orthogonal to the rotational axis of the drum 62. Furthermore, as shown in FIG. 3, a scoop sheet 65 for preventing the waste toner from leaking out of the cleaning frame 71 is provided on an edge of the cleaning frame 71 so as to contact the drum 62.

The drum 62 is driven to rotate in the direction of the arrow R in the figures in accordance with an image formation operation upon reception of driving force from a main body drive motor (not shown) serving as a drive source. The charging roller 66 is attached to the cleaning unit 60 rotatably via a charging roller bearing 67 at respective longitudinal direction ends of the cleaning frame 71 (the longitudinal direction being substantially parallel to the rotational axis direction of the drum 62). The charging roller 66 is pressed against the drum 62 by pressing the charging roller bearing 67 toward the drum 62 using a biasing member 68. The charging roller 66 is driven to rotate by the rotation of the drum 62. As shown in FIG. 3, the developing unit 20 includes the developing roller 32, a developer container 23 that supports the developing roller 32, a developing blade 42, and so on. The magnet roller 34 is provided in the developing roller 32. Further, the developing blade 42 is disposed in the developing unit 20 to restrict the toner layer formed on the developing roller 32. As shown in FIGS. 10 and 12, interval maintaining members 38 are attached to respective ends of the developing roller 32, and when the interval maintaining members 38 contact the drum 62, a very small gap is maintained between the developing roller 32 and the drum 62. Furthermore, as shown in FIG. 3, a blow-out prevention sheet 33 for preventing the toner from leaking out of the developing unit 20 is provided on an edge of a bottom member 22 so as to contact the developing roller 32. Moreover, the first transport member 43, the second transport member 44, and the third transport member 50 are provided in the toner chamber 29, which is formed by the developer container 23 and the bottom member 22. The first transport member 43, the second transport member 44, and the third transport member 50 agitate the toner housed in the toner chamber 29, and transport the toner to the toner supply chamber 28.

As shown in FIGS. 10 and 12, the cleaning frame 71, the lid member 72, the drum 62, and the drum bearing 73 and a drum shaft 78 for rotationally supporting the drum 62 are provided in the cleaning unit 60. As shown in FIG. 13, on the drive side, a drive-side drum flange 63 provided on the drive side of the drum 62 is supported rotatably by a hole 73*a* in the drum bearing 73. On the non-drive side, meanwhile, as shown in FIG. 11, the drum shaft 78, which is press-fitted into a hole 71*c* provided in the cleaning frame 71, supports a hole (not shown) in a non-drive-side drum flange 64 rotatably.

Meanwhile the developing unit 20, as shown in FIGS. 3, 10, and 12, is constituted by the bottom member 22, the developer container 23, a drive-side development side member 26, the developing blade 42, the developing roller 32, and so on. Further, the developing roller 32 is attached to the developer container 23 rotatably by bearing members 27, 37 provided at respective ends thereof. As shown in FIGS. 11 and 13, the cartridge B is formed by joining the cleaning unit 60 and the developing unit 20 to each other rotatably using a joining pin 69. More specifically, a development first support hole 23*a* and a development second support hole 23*b* are provided in the developer container 23 at respective longitudinal direction ends of the developing unit 20. Further, a first suspension hole 71*i* and a second suspension hole 71*j* are provided in the cleaning frame 71 at respective longitudinal direction ends of the cleaning unit 60. The cleaning unit 60 and the developing unit 20 are coupled to each other rotatably by fitting the joining pin 69, which is press-fitted fixedly into the first suspension hole 71*i* and the second suspension hole 71*j*, into the development first support hole 23*a* and the development second support hole 23*b*. Furthermore, in FIG. 13, a first hole 46Ra and a second hole 46Rb formed in a drive-side biasing member 46R are hooked onto a boss 73*c* of the drum bearing 73 and a boss 26*a* of the drive-side development side member 26, respectively. Further, in FIG. 11, a first hole 46Fa and a second hole 46Fb formed in a non-drive-side biasing member 46F are hooked onto a boss 71*k* of the cleaning frame 71 and a boss 37*a* of the bearing member 37, respectively.

In this embodiment, the drive-side biasing member 46R and the non-drive-side biasing member 46F are formed from tension springs and configured to bias the developing unit 20 toward the cleaning unit 60 using the biasing force of the springs so that the developing roller 32 is reliably pushed in the direction of the drum 62. A predetermined interval is maintained between the developing roller 32 and the drum 62 by the interval maintaining members 38 attached to the respective ends of the developing roller 32. Further, a torsion coil spring 80 serving as biasing member for biasing the first coupling 70 is attached to a boss 73*e* of the drum bearing 73, and a torsion coil spring 47 serving as biasing member for biasing the second coupling 21 is attached to a boss 26*b* of the drive-side development side member 26.

Description of Coupling Member

Figure 1A:
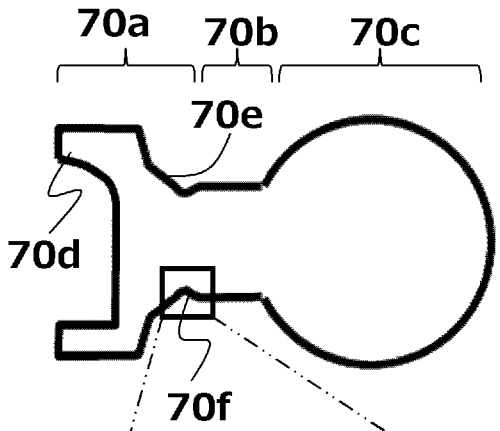
FIGS. 1A and 1B are illustrative views of a groove provided in a coupling member according to a first embodiment.
Figure 1B:
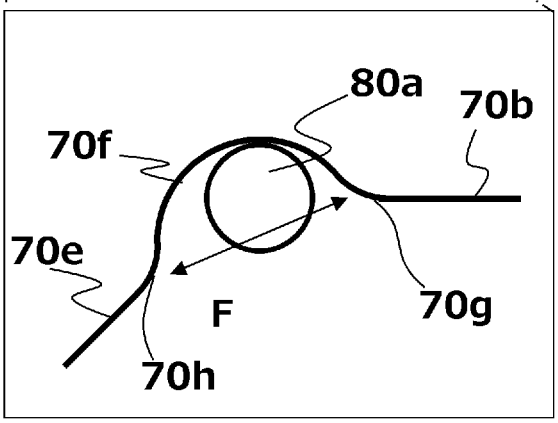
Figure 14A:
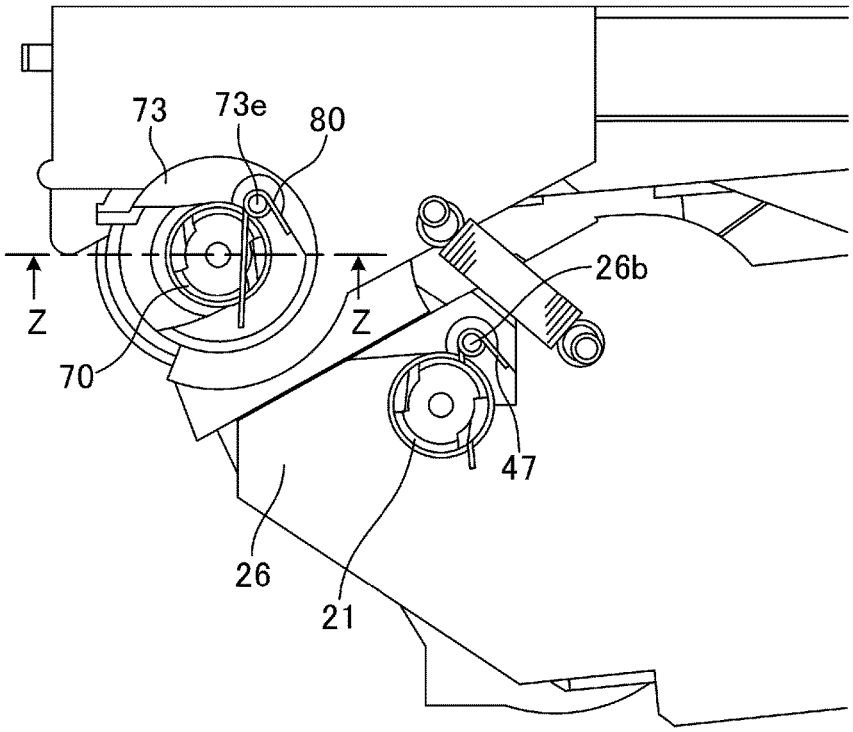
FIGS. 14A to 14C are views showing a relationship between a coupling member and a biasing member during image formation, according to the first embodiment.
Figure 14B:
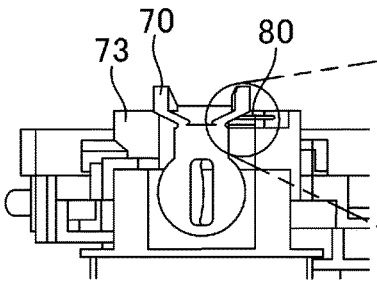
Figure 14C:
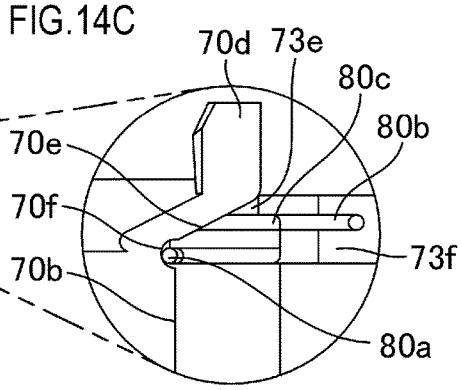

Next, the first coupling 70 will be described using FIGS. 1 and 14. Note that the second coupling 21 is configured identically to the first coupling 70, and therefore description thereof has been partially omitted. FIGS. 1A and 1B are illustrative views of a groove 70*f* formed in the first coupling 70. FIG. 1A is a schematic view of the first coupling 70, and FIG. 1B is a schematic view of the vicinity of the groove 70*f* formed in the first coupling 70. FIGS. 14A to 14C are views showing a relationship between the first coupling 70 and the torsion coil spring 80 during image formation. FIG. 14A is a view showing the first coupling 70 during image formation from the rotational axis direction of the drum 62, FIG. 14B is a sectional view cut along a Z-Z section, and FIG. 14C is a Z sectional view showing the vicinity of the groove 70*f* formed in the first coupling 70 in detail.

As shown in FIGS. 1A and 1B, the first coupling 70 includes three main parts. A first part is an end portion 70*a* that is engaged to the first drive shaft 14 (not shown), which serves as a main body side engagement portion, in order to receive rotary force from the first drive shaft 14. The end portion 70*a* is constituted by a force receiving portion 70*d* for receiving driving force from main body of the apparatus, and a tapered portion 70*e* having a tapered surface that tapers from the force receiving portion 70*d* toward a shaft portion 70*b* serving as a peripherally shaped portion, to be described below. A second part is a substantially spherical ball portion 70*c*. The ball portion 70*c* serves as a transmission portion for transmitting driving force to the drum 62, and is held tiltably by the drive-side drum flange 63 (not shown), which serves as a transmission destination member. A third part is the shaft portion 70*b*, which is a peripherally shaped portion having a peripheral surface and connecting the end portion 70*a* to the ball portion 70*c*. The second coupling 21 also includes three parts. A first part is an end portion 21*a* that is engaged to the second drive shaft 19 in order to receive rotary force from main body of the apparatus. A second part is a ball portion 21*c* that serves as a transmission portion for transmitting driving force to the developing roller 32. A third part is a shaft portion 21*b* serving as a peripherally shaped portion that connects the end portion 21*a* to the ball portion 21*c*. Further, as shown in FIGS. 1 and 14, a groove 70*f* formed in an annular shape is provided between the shaft portion 70*b* and the tapered portion 70*e* so as to extend in a circumferential direction. More specifically, the groove 70*f* is configured such that when seen on a rotational axis direction cross-section, a first edge 70*g* thereof is provided on a boundary between the peripheral surface of the shaft portion 70*b* and the tapered portion 70*e*, and a second edge 70*h* thereof is provided on a boundary between a surface of the tapered portion 70*e* and the shaft portion 70*b*. The groove 70*f* is provided in a location where virtual planes extending respectively from the first edge 70*g* and the second edge 70*h* intersect. A distance between the first edge 70*g* and the second edge 70*h* is set as an opening width F of the groove 70*f*. In this case, the opening width F is wider than a wire diameter of the wire-shaped torsion coil spring 80 that serves as biasing member for tilting the first coupling 70 so that a first arm 80*a* of the torsion coil spring 80 enters the groove 70*f*. Here, the torsion coil spring 80 is formed by bending metal wire into a coil shape. Further, the wire diameter of the torsion coil spring 80 is the diameter of a part (the first arm 80*a*) of the torsion coil spring 80 that is fitted into the groove 70*f*.

Figure 15:
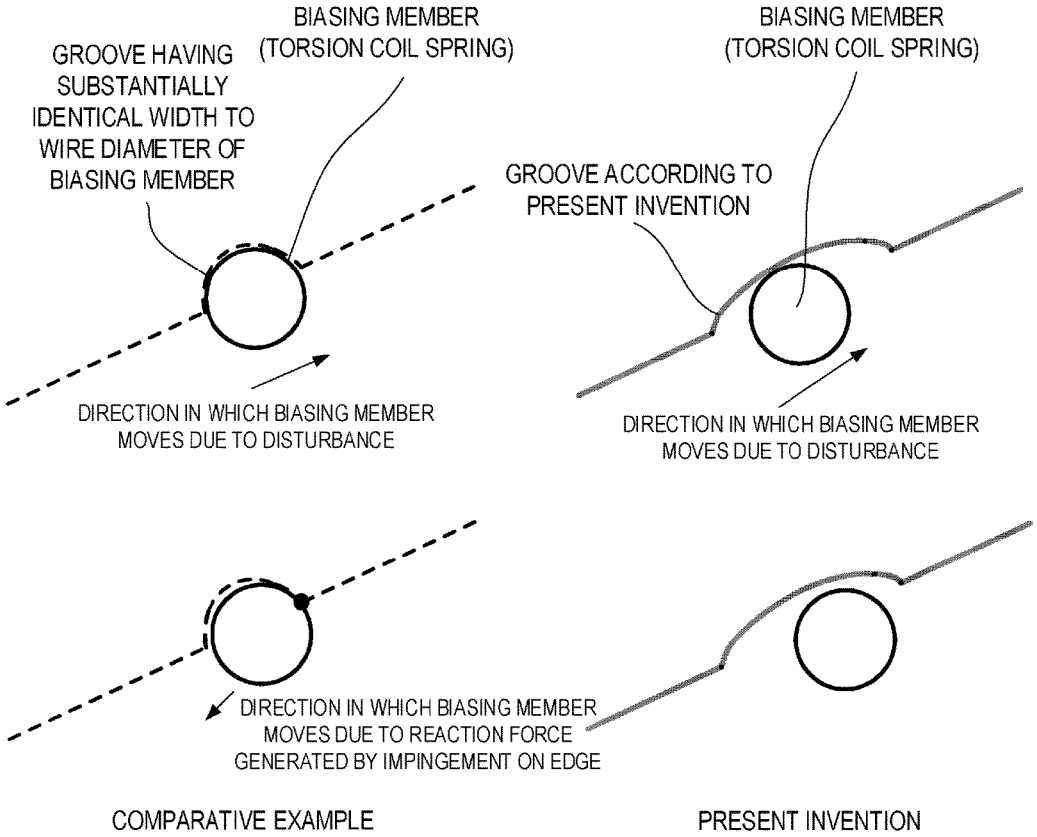
FIG. 15 is a view comparing a groove according to the first embodiment with a groove having an opening width that is identical to a wire diameter of the biasing member.

Here, making the opening width F of the groove wider than the wire diameter of the torsion coil spring 80 has the following advantage. FIG. 15 is a view comparing the groove according to the present invention, in which the opening width F is wider than the wire diameter of the torsion coil spring 80 serving as a biasing member, with a groove according to a comparative example, in which the opening width F is substantially identical to the wire diameter of the torsion coil spring 80. By making the opening width F wider than the wire diameter of the torsion coil spring 80 serving as the biasing member, an amount by which the torsion coil spring moves relative to the groove can be increased. Hence, even in a situation where the torsion coil spring 80 almost becomes detached from the groove 70*f* due to a disturbance such as vibration, the distance from the interior of the groove to the edges of the groove is large, and therefore the first arm 80*a* of the torsion coil spring 80 is more likely to remain inside the groove 70*f*. Further, as shown in FIG. 15, when the opening width F of the groove 70*f* is identical to the wire diameter of the torsion coil spring 80, the first arm 80*a* of the torsion coil spring 80 is fitted tightly into the groove 70*f*. Therefore, when a disturbance such as vibration occurs, the torsion coil spring 80 does not have any leeway to move within the groove interior, and as a result, the torsion coil spring 80 easily becomes detached. Hence, the first arm 80*a* of the torsion coil spring 80 must remain in the groove 70*f* even when a disturbance such as vibration acts thereon. Therefore, the opening width F is preferably made wider than the wire diameter of the torsion coil spring 80 by forming the groove to have a rotational axis direction cross-section that extends in a smooth arc shape from the opening to the bottom of the groove 70*f*. In a case where the opening width F of the groove 70*f* is wider than the wire diameter of the torsion coil spring 80, when a disturbance such as vibration occurs, the torsion coil spring 80 has leeway to move within the interior of the groove as long as the disturbance is within the range of the groove width. Accordingly, the torsion coil spring 80 is less likely to impinge on the edge of the groove 70*f* or the like such that movement thereof is restricted, and as a result, the biasing member is unlikely to become detached from the groove.

Tilting Operation of Couplings

Figure 16:
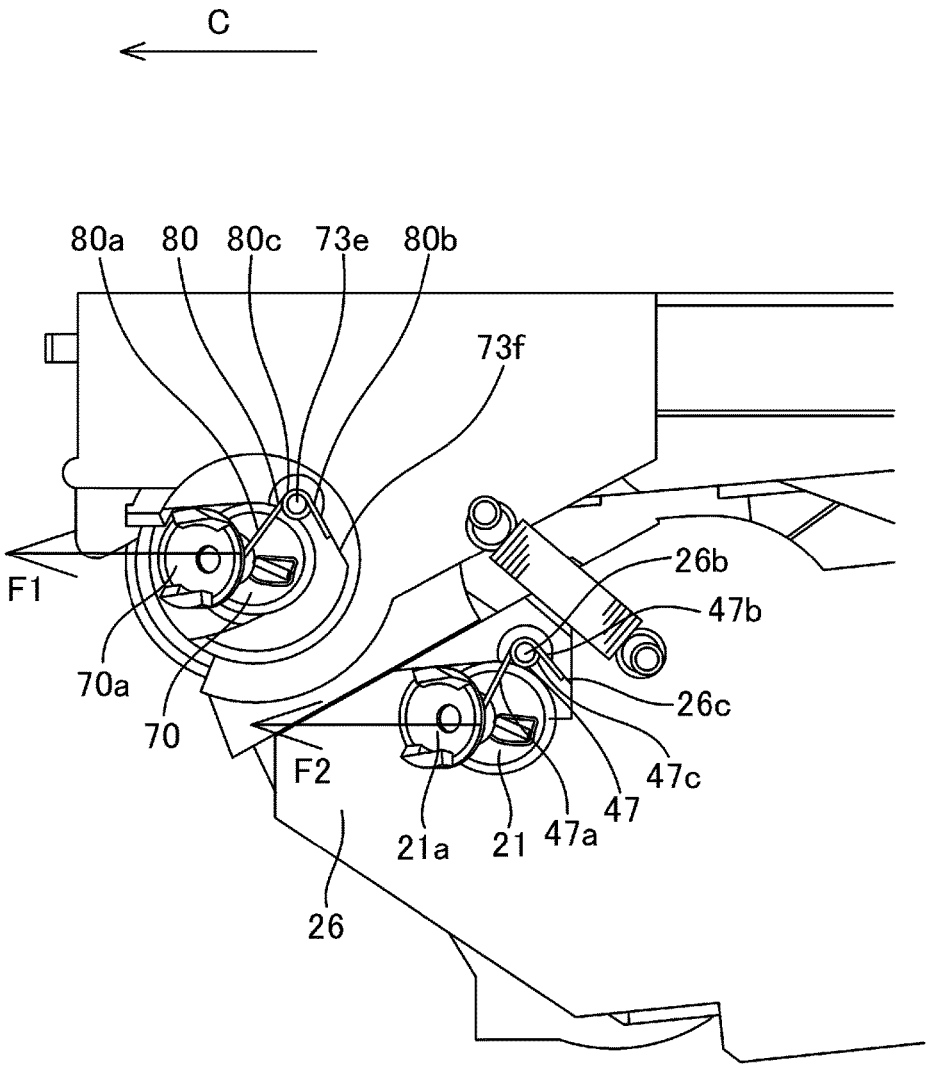
FIG. 16 is an illustrative view showing the coupling member according to the first embodiment in a biased state.

Next, tilting of the first coupling 70 and the second coupling 21 will be described using FIGS. 1, 13, and 16. FIG. 16 is an illustrative view showing the first coupling 70 and the second coupling 21 in a biased state. As shown in FIG. 13, the drum bearing 73 is constituted by the hole 73*a*, the supported portion 73*b*, the boss 73*c*, the supported portion 73*d*, the boss 73*e*, and a receiving portion 73*f*. The drive-side development side member 26 is constituted by the boss 26*a*, the boss 26*b*, and a receiving portion 26*c*. As shown in FIG. 16, the torsion coil spring 80 serving as the biasing member for tilting the first coupling 70 is attached to the boss 73*e* of the drum bearing 73. A coil 80*c* is hooked around the boss 73*e* such that the first arm 80*a* contacts the groove 70*f* of the first coupling 70 and a second arm 80*b* contacts the receiving portion 73*f*. Thus, the torsion coil spring 80 biases the first coupling 70 by a biasing force F1 such that the end portion 70*a* (the side on which the force receiving portion 70*d* is provided) of the first coupling 70 tilts toward a downstream side (in the direction of an arrow C) in a mounting direction in which the cartridge B is mounted in main body of the apparatus up to a predetermined mounting position. Accordingly, the force receiving portion 70*d* is oriented so as to face the first drive shaft 14 of main body of the apparatus, and can therefore be engaged to the first drive shaft 14 easily. As a result, the cartridge B can be mounted smoothly.

Similarly, the torsion coil spring 47 serving as the biasing member for tilting the second coupling 21 is attached to the boss 26*b* of the drive-side development side member 26. A coil 47*c* is hooked around the boss 26*b* such that a first arm 47*a* contacts a groove 21*f* of the second coupling 21 and a second arm 47*b* contacts the receiving portion 26*c*. Thus, the torsion coil spring 47 biases the second coupling 21 by a biasing force F2 so that the end portion 21*a* of the second coupling 21 is oriented toward the downstream side in the cartridge mounting direction (the direction of the arrow C), or in other words toward the second drive shaft 19 of main body of the apparatus. Further, the wire diameter of the torsion coil spring 47 is the diameter of the part (the first arm 47*a*) of the torsion coil spring 47 that is fitted into the groove 21*f*.

Furthermore, a size, a depth, and so on of the groove are preferably set appropriately so that the first arm 80*a* of the torsion coil spring 80, as shown in FIGS. 1A and 1B, does not impede tilting of the first coupling 70 when fitted into the groove 70*f* in the first coupling 70. In this embodiment, this is achieved by making the opening width of the groove 70*f* wider than the wire diameter of the torsion coil spring 80 serving as the biasing member, and forming the groove 70*f* to have a rotational axis direction cross-section that extends in a smooth arc shape from the opening to the bottom of the groove, as described above. When the groove is formed to have these characteristics, the torsion coil spring 80 can slide in the groove interior. As a result, the first coupling 70 can tilt without being impeded, and can therefore be biased. This applies similarly to the second coupling 21 and the torsion coil spring 47.

Coupling Engagement Operation

Figure 17A:
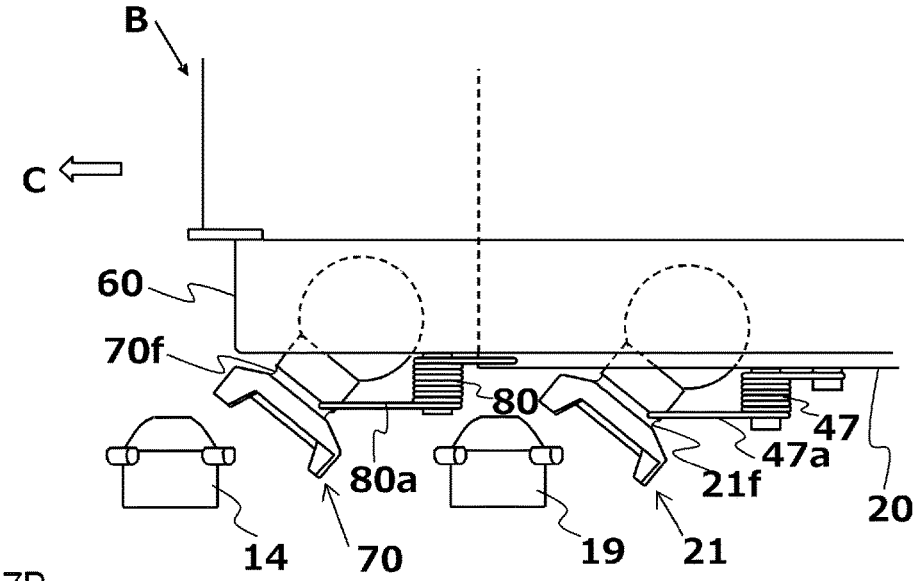
FIGS. 17A and 17B are illustrative views of an engagement operation implemented on the coupling member according to the first embodiment.
Figure 17B:
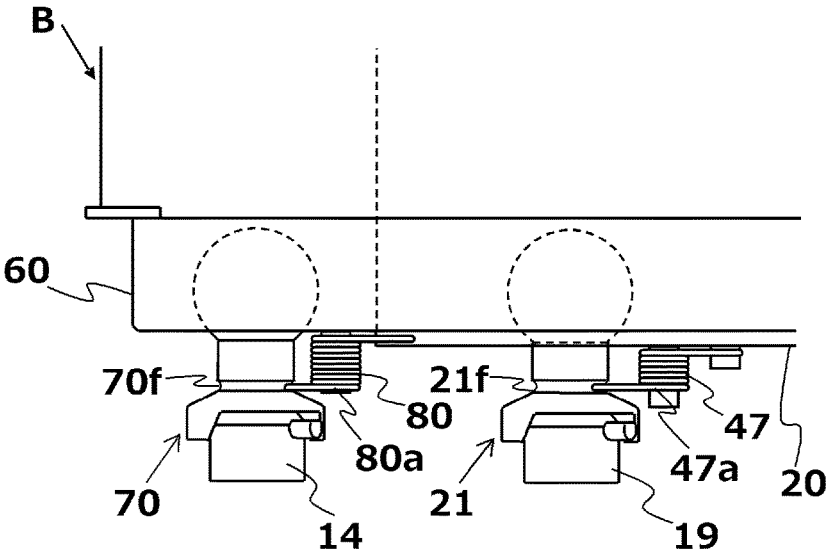

Next, engagement of the first coupling 70 and the second coupling 21 will be described using FIGS. 16 and 17. FIGS. 17A and 17B are illustrative views of an operation for engaging the first coupling 70 and the second coupling 21 to engagement portions of main body A of the apparatus. FIG. 17A is an illustrative view showing the first coupling 70 and the second coupling 21 prior to engagement, and FIG. 17B is an illustrative view showing the first coupling 70 and the second coupling 21 following engagement (during image formation). As shown in FIGS. 16 and 17A, before being engaged to the first drive shaft 14, the first coupling 70 is biased so as to face the downstream side of the mounting direction of the cartridge B (the direction of the arrow C), or in other words so as to face the first drive shaft 14. When the cartridge B is mounted, as shown in FIG. 17B, the first coupling 70 is engaged to the first drive shaft 14 in main body A of the apparatus such that respective rotational axes of the first drive shaft 14, the first coupling 70, and the drum 62 (not shown) are substantially identical. As a result, the drum 62 (not shown) coupled to the first coupling 70 receives driving force from main body A of the apparatus so as to rotate. At this time, the first arm 80*a* of the torsion coil spring 80 is housed in the groove 70*f* of the first coupling 70, and therefore a contact position in which the torsion coil spring 80 contacts the first coupling 70 is limited.

Similarly, in FIG. 17A, before being engaged to the second drive shaft 19, the second coupling 21 is biased so as to face the downstream side of the mounting direction of the cartridge B (the direction of the arrow C), or in other words so as to face the second drive shaft 19. When the cartridge B is mounted, as shown in FIG. 17B, the second coupling 21 is engaged to the second drive shaft 19 in main body A of the apparatus such that respective rotational axes of the second drive shaft 19, the second coupling 21, and the developing roller 32 (not shown) are substantially identical. As a result, the developing roller 32 (not shown) coupled to the second coupling 21 receives driving force from main body A of the apparatus so as to rotate. At this time, the first arm 47*a* of the torsion coil spring 47 is housed in the groove 21*f* of the second coupling 21, and therefore a contact position in which the torsion coil spring 47 contacts the second coupling 21 is limited. Further, by providing the groove 70*f* between the shaft portion 70*b* serving as the peripherally shaped portion and the tapered portion 70*e*, the contact state of the torsion coil spring 80 can be stabilized. Moreover, by having the torsion coil spring 80 contact the tapered portion 70*e*, the biasing force F of the torsion coil spring 80 acts on the first coupling 70 such that a component force thereof acts on the tapered portion 70*e* of the first coupling 70. As a result, the first coupling 70 can be pulled out toward the first drive shaft 14 (not shown) in the axial direction of the drum 62 through a component gap relative to the drive-side drum flange 63 (not shown), and can therefore easily be maintained in an attitude enabling easy engagement to the first drive shaft 14. Similarly, the second coupling 21 can be pulled out toward the second drive shaft 19 in the axial direction of the developing roller 32, and can therefore easily be maintained in an attitude enabling easy engagement to the second drive shaft 19. Hence, the biasing member can be more reliably limited to a fixed position relative to the coupling member. Further, when the groove extending around the circumference of the coupling member is coated with lubricant, the lubricant can accumulate in the groove interior due to the aforesaid arc-shaped rotational axis direction cross-section of the groove so that the lubricant exists between the coupling member and the biasing member at all times. The lubricant thus serves to reduce friction between the coupling member and the torsion coil spring 80, and as a result, an increase in the lifespan of the coupling member can be expected.

Figure 18A:
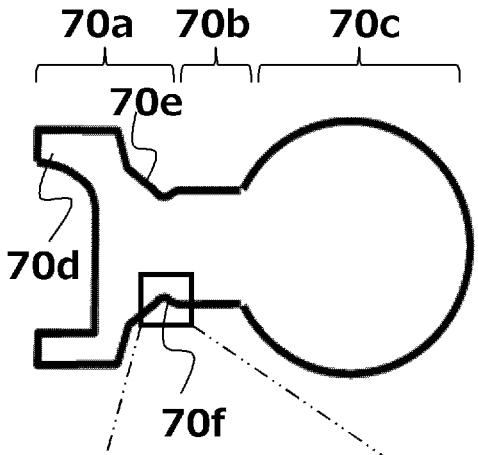
FIGS. 18A and 18B are illustrative views of a modified example of the groove provided in the coupling member according to the first embodiment.
Figure 18B:
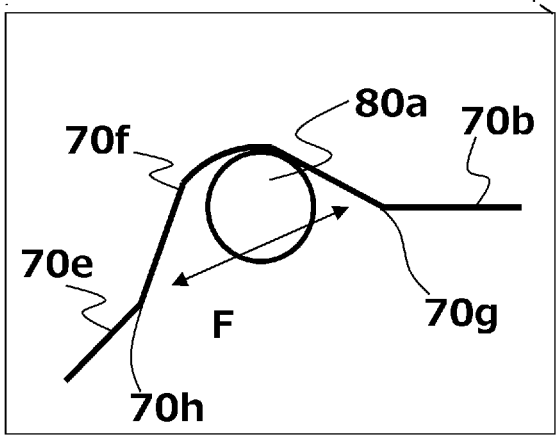

Note that in this embodiment, an example in which the groove extending around the circumference of the coupling member is formed to have an arc-shaped cross-section was described, but the shape of the groove is not limited thereto. As shown in FIGS. 18A and 18B, for example, the groove may be formed in a tapered shape that increases in diameter from the bottom toward the opening such that the biasing member is enticed into the groove. In other words, the groove may be formed in any shape with which the width F of the opening is wider than the wire diameter of the torsion coil spring that contacts the groove so that lubricant can accumulate in the groove. Further, in this embodiment, an example in which a torsion coil spring is used as the biasing member was described, but the biasing member is not limited thereto, and a similar configuration can be realized by having a biasing member such as a plate spring, for example, slide against the coupling member.

Second Embodiment

Figure 19A:
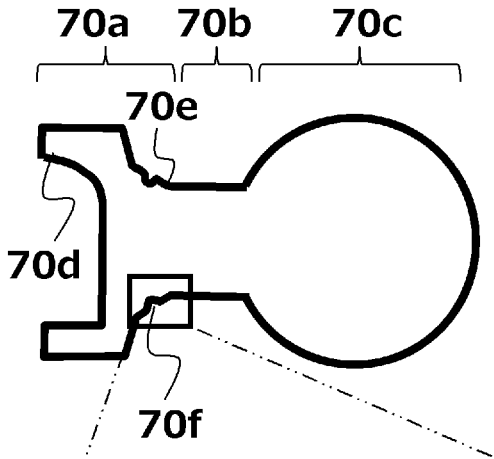
FIGS. 19A and 19B are illustrative views of a groove provided in a coupling member according to a second embodiment.
Figure 19B:
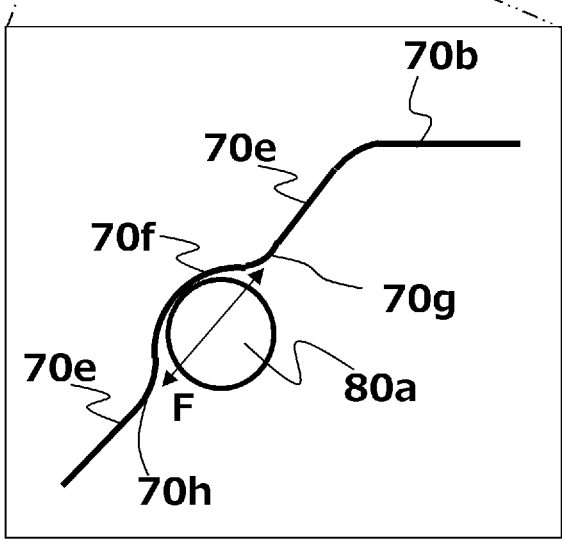

Next, a second embodiment of the present invention will be described on the basis of the figures. Note that in this embodiment, parts that differ from the above embodiment will be described in detail. Unless specifically noted otherwise, all materials, shapes, and so on are identical to those of the above embodiment. Identical reference numerals have been allocated to identical parts, and detailed description thereof has been omitted. With respect to the groove 70*f* of the first coupling 70, examples of shapes that differ from the first embodiment will be described using FIGS. 19A and 19B. Note that since the second coupling 21 is configured identically to the first coupling 70, only a part thereof will be described. FIGS. 19A and 19B are illustrative views of the groove 70*f* of the first coupling 70 according to the second embodiment. FIG. 19A is a schematic view of the first coupling 70, and FIG. 19B is a schematic view of the vicinity of the groove 70*f* formed in the first coupling 70.

As shown in FIG. 19A, the first coupling 70 includes three main parts. A first part is the end portion 70*a* that is engaged to the first drive shaft 14 (not shown) serving as the main body side engagement portion in order to receive rotary force from the first drive shaft 14. The end portion 70*a* is constituted by the force receiving portion 70*d* for receiving driving force from main body of the apparatus, and the tapered portion 70*e* that tapers from the force receiving portion 70*d* toward the shaft portion 70*b* serving as the peripherally shaped portion, to be described below. A second part is the substantially spherical ball portion 70*c*. The ball portion 70*c* serves as the transmission portion for transmitting driving force to the drum 62, and is held tiltably by the drive-side drum flange 63 (not shown) serving as the transmission destination member. A third part is the shaft portion 70*b*, which is a peripherally shaped portion connecting the end portion 70*a* to the ball portion 70*c*. The second coupling 21 also includes three parts. A first part is the end portion 21*a* that is engaged to the second drive shaft 19 in order to receive rotary force from main body of the apparatus. A second part is the ball portion 21*c* that serves as the transmission portion for transmitting driving force to the developing roller 32. A third part is the shaft portion 21*b* serving as the peripherally shaped portion that connects the end portion 21*a* to the ball portion 21*c*. Further, the groove 70*f* formed in an annular shape is provided in the tapered portion 70*e* so as to extend in a circumferential direction. More specifically, in contrast to the first embodiment, the groove 70*f* is configured such that both edges thereof are provided on the surface of the tapered portion 70*e*. Further, a distance between the two edges on the surface of the tapered portion 70*e* is set as the opening width F of the groove 70*f* according to the second embodiment. In this case, the opening width F is wider than the wire diameter of the wire-shaped torsion coil spring 80 that serves as the biasing member for tilting the first coupling 70 so that the first arm 80*a* of the torsion coil spring 80 enters the groove 70*f*. As a result, similarly to the first embodiment, the amount by which the torsion coil spring moves relative to the groove can be increased. Hence, even in a situation where the torsion coil spring 80 almost becomes detached from the groove 70*f* due to a disturbance such as vibration, the distance from the interior of the groove to the edges of the groove is large, and therefore the first arm 80*a* of the torsion coil spring 80 is more likely to remain inside the groove 70*f*.

Further, similarly to the first embodiment, before being engaged to the first drive shaft 14, the first coupling 70 is biased so as to face the downstream side of the mounting direction of the cartridge B, or in other words so as to face the first drive shaft 14. When the cartridge B is mounted, the first coupling 70 is engaged to the first drive shaft 14 such that the respective rotational axes of the first drive shaft 14, the first coupling 70, and the drum 62 are substantially identical. As a result, the drum 62 coupled to the first coupling 70 receives driving force from main body of the apparatus so as to rotate. At this time, the first arm 80*a* of the torsion coil spring 80 is housed in the groove 70*f* of the first coupling 70, and therefore the contact position in which the torsion coil spring 80 contacts the first coupling 70 during image formation can be limited. Furthermore, by providing the groove 70*f* in the tapered portion 70*e* and causing the torsion coil spring 80 to contact the groove 70*f*, a component force of the biasing force F of the torsion coil spring 80 acts on the tapered portion 70*e* of the first coupling 70. As a result, the first coupling 70 can be pulled out toward the first drive shaft 14 (not shown) in the axial direction of the drum 62 through the component gap relative to the drive-side drum flange 63 (not shown), and can therefore easily be maintained in an attitude enabling easy engagement to the first drive shaft 14. This applies likewise to the second coupling 21.

Hence, the biasing member can be more reliably limited to a fixed position relative to the coupling member. Further, when the groove extending around the circumference of the coupling member is coated with lubricant, the lubricant can accumulate in the groove due to the aforesaid arc-shaped rotational axis direction cross-section of the groove so that the lubricant exists between the coupling member and the biasing member at all times. The lubricant thus serves to reduce friction between the coupling member and the torsion coil spring 80, and as a result, an increase in the lifespan of the coupling member can be expected.

Third Embodiment

Figure 20A:
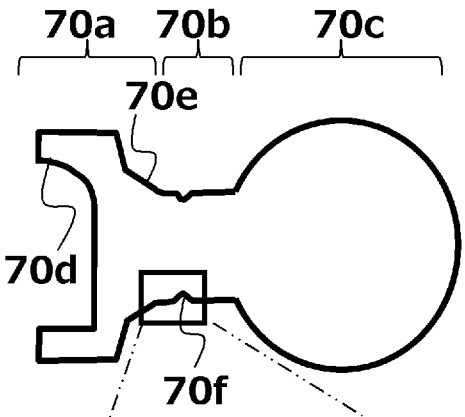
FIGS. 20A and 20B are illustrative views of a groove provided in a coupling member according to a third embodiment.
Figure 20B:
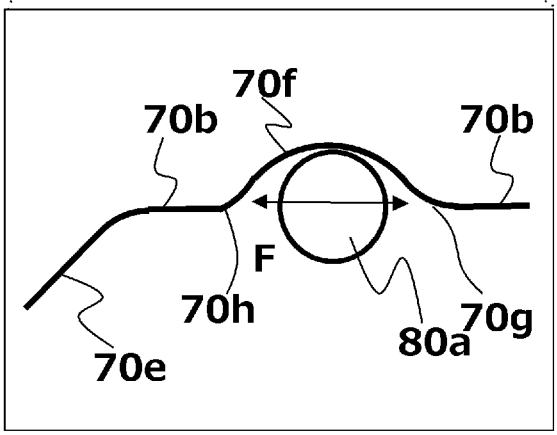

Next, a third embodiment of the present invention will be described on the basis of the figures. Note that in this embodiment, parts that differ from the above embodiments will be described in detail. Unless specifically noted otherwise, all materials, shapes, and so on are identical to those of the above embodiments. Identical reference numerals have been allocated to identical parts, and detailed description thereof has been omitted. With respect to the groove 70*f* of the first coupling 70, examples of shapes that differ from the first embodiment will be described using FIGS. 20A and 20B. Note that since the second coupling 21 is configured identically to the first coupling 70, only a part thereof will be described. FIGS. 20A and 20B are illustrative views of the groove 70*f* of the first coupling 70 according to the third embodiment. FIG. 20A is a schematic view of the first coupling 70, and FIG. 20B is a schematic view of the vicinity of the groove 70*f* formed in the first coupling 70.

As shown in FIG. 20A, the first coupling 70 includes three main parts. A first part is the end portion 70*a* that is engaged to the first drive shaft 14 (not shown) serving as the main body side engagement portion in order to receive rotary force from the first drive shaft 14. The end portion 70*a* is constituted by the force receiving portion 70*d* for receiving driving force from main body of the apparatus, and the tapered portion 70*e* that tapers toward the shaft portion 70*b* serving as the peripherally shaped portion, to be described below. A second part is the substantially spherical ball portion 70*c*. The ball portion 70*c* serves as the transmission portion for transmitting driving force to the drum 62, and is held tiltably by the drive-side drum flange 63 (not shown) serving as the transmission destination member. A third part is the shaft portion 70*b*, which is a peripherally shaped portion connecting the end portion 70*a* to the ball portion 70*c*. The second coupling 21 also includes three parts. A first part is the end portion 21*a* that is engaged to the second drive shaft 19 in order to receive rotary force from main body of the apparatus. A second part is the ball portion 21*c* that serves as the transmission portion for transmitting driving force to the developing roller 32. A third part is the shaft portion 21*b* serving as the peripherally shaped portion that connects the end portion 21*a* to the ball portion 21*c*. Further, the groove 70*f* formed in an annular shape is provided in the shaft portion 70*b* so as to extend in a circumferential direction. More specifically, in contrast to the first and second embodiments, the groove 70*f* is configured such that both edges thereof are provided on the surface of the shaft portion 70*b* serving as the peripherally shaped portion. Further, a distance between the two edges on the surface of the shaft portion 70*b* of the groove 70*f* is set as the opening width F of the groove 70*f* according to the third embodiment. In this case, the opening width F is wider than the wire diameter of the wire-shaped torsion coil spring 80 serving as the biasing member for tilting the first coupling 70 so that the first arm 80*a* of the torsion coil spring 80 enters the groove 70*f*. As a result, similarly to the first and second embodiments, the amount by which the torsion coil spring moves relative to the groove can be increased. Hence, even in a situation where the torsion coil spring 80 almost becomes detached from the groove 70*f* due to a disturbance such as vibration, the distance from the interior of the groove to the edges of the groove is large, and therefore the first arm 80*a* of the torsion coil spring 80 is more likely to remain inside the groove 70*f*. For this purpose, similarly to the first and second embodiments, the opening width F is preferably made wider than the wire diameter of the torsion coil spring 80 by forming the groove to have a rotational axis direction cross-section that extends in a smooth arc shape from the opening to the bottom of the groove 70*f*. The cross-section of the groove is not limited to an arc shape, however, and the groove may be formed in any shape with which the width F of the opening is wider than the wire diameter of the torsion coil spring that contacts the groove so that lubricant can accumulate in the groove.

As a result, the contact position in which the torsion coil spring 80 contacts the first coupling 70 during image formation can be limited. Furthermore, by providing the groove 70*f* in the shaft portion 70*b*, the contact state of the torsion coil spring 80 can be further stabilized. Hence, the biasing member can be more reliably limited to a fixed position relative to the coupling member. Further, when the groove extending around the circumference of the coupling member is coated with lubricant, the lubricant can accumulate in the groove interior so that the lubricant exists between the coupling member and the biasing member at all times. The lubricant thus serves to reduce friction between the coupling member and the torsion coil spring 80, and as a result, an increase in the lifespan of the coupling member can be expected.

Fourth Embodiment

Next, a fourth embodiment of the present invention will be described on the basis of the figures. Note that in this embodiment, parts that differ from the above embodiments will be described in detail. Unless specifically noted otherwise, all materials, shapes, and so on are identical to those of the above embodiments. Identical reference numerals have been allocated to identical parts, and detailed description thereof has been omitted.

Figure 21:
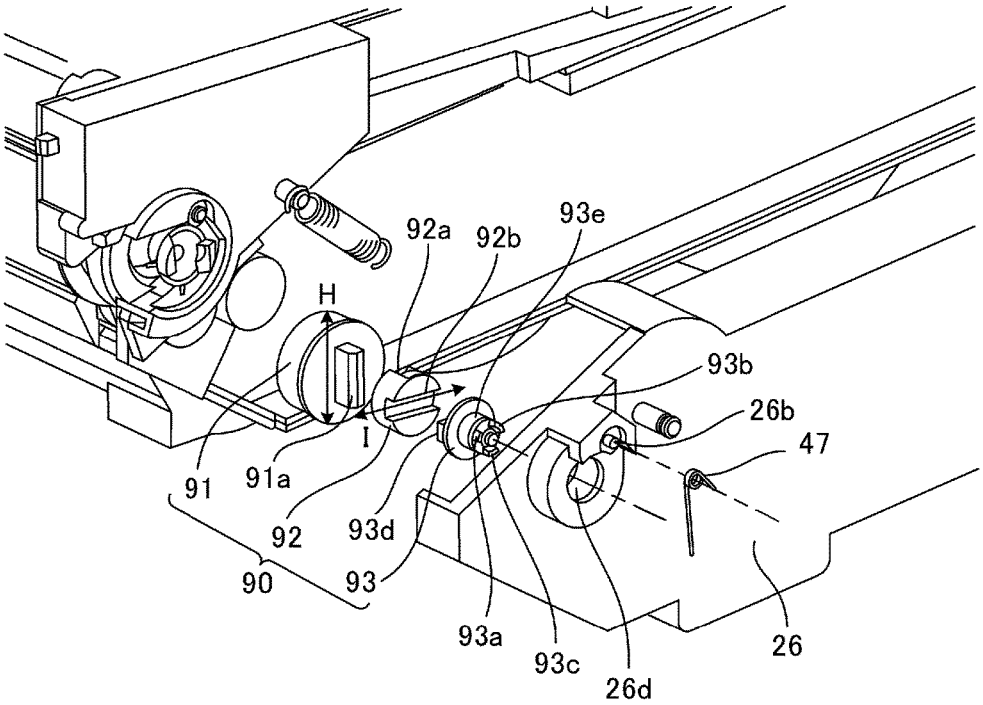
FIG. 21 is an illustrative view of a coupling member according to a fourth embodiment.
Figure 22A:
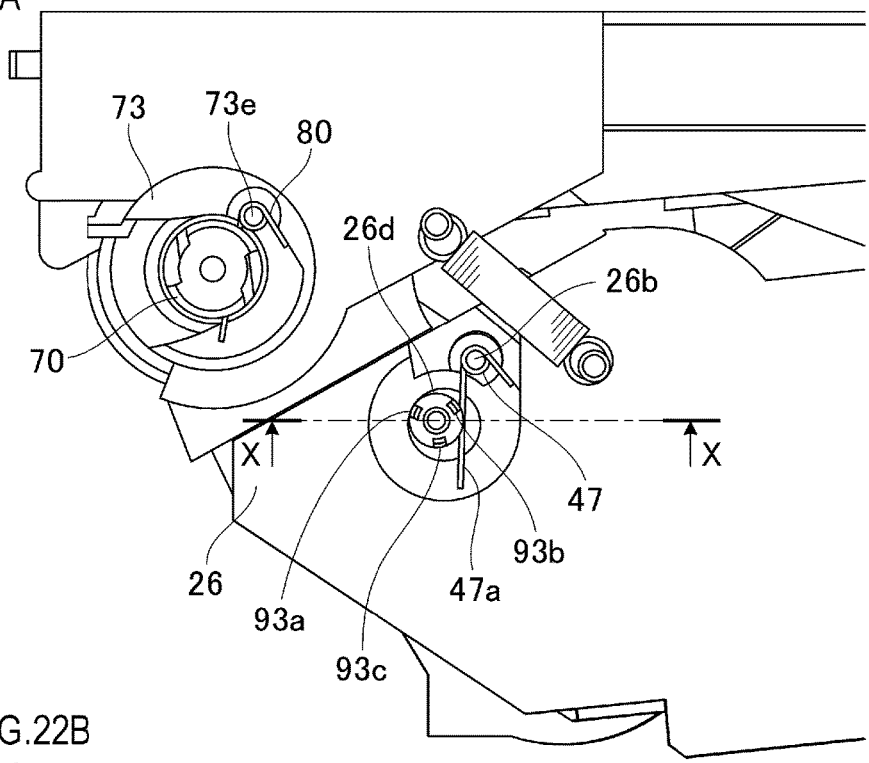
FIGS. 22A to 22C are illustrative views of the coupling member according to the fourth embodiment in a biased state.
Figure 22B:
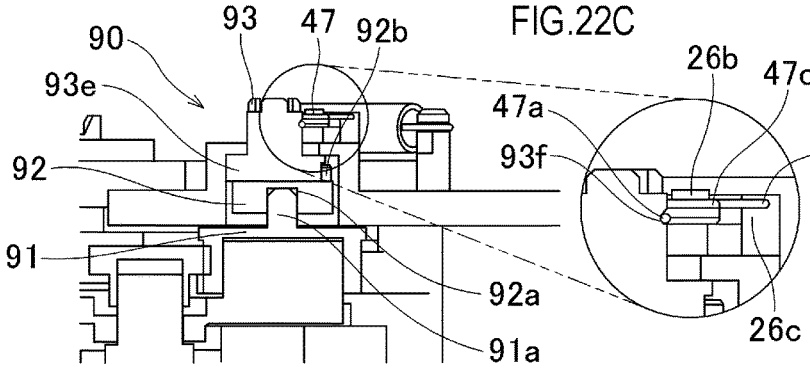
Figure 22C:
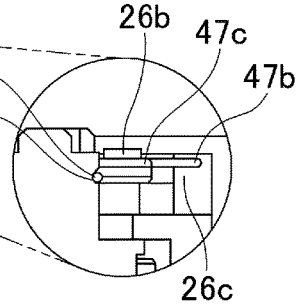
Figure 23A:
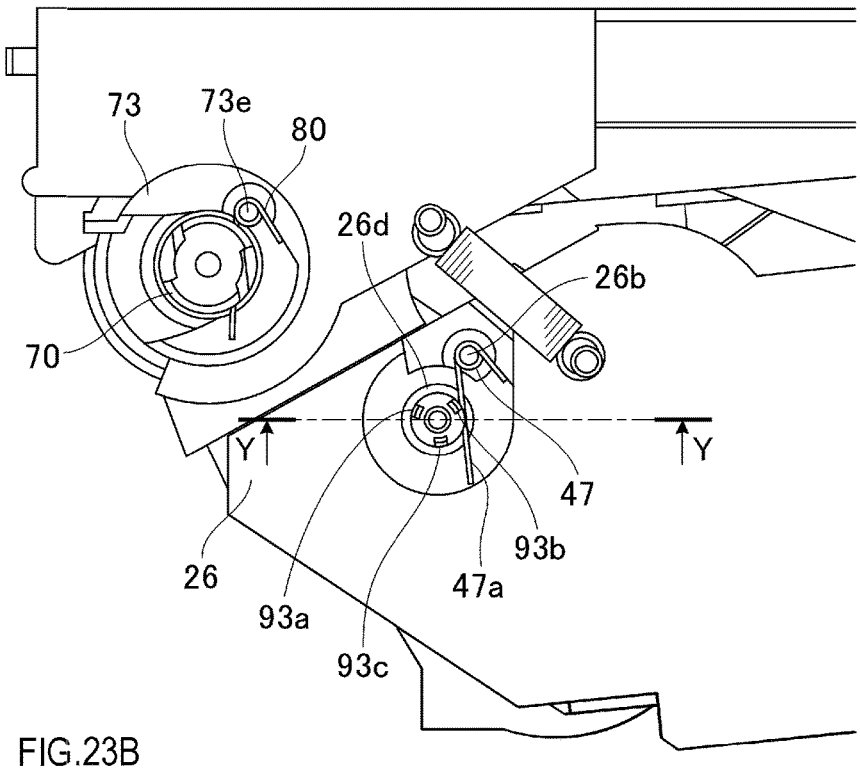
FIGS. 23A to 23C are views showing a relationship between the coupling member and a biasing member during image formation, according to the fourth embodiment.
Figure 23B:
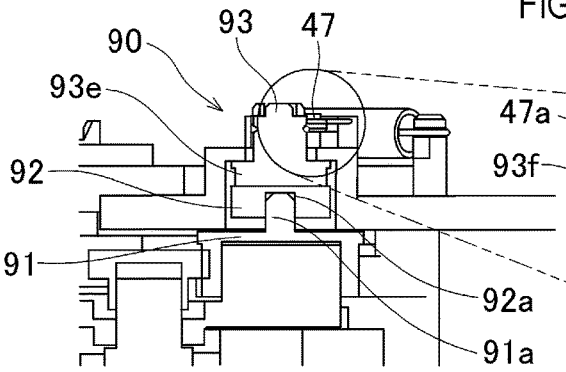
Figure 23C:
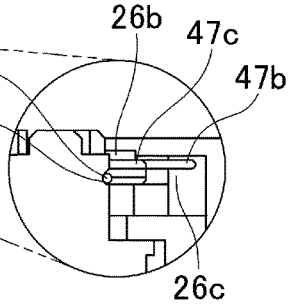

An embodiment in which an Oldham coupling 90 configured differently to the first embodiment is used as the second coupling 21 will be described using FIGS. 21, 22, and 23. FIG. 21 is a view showing a configuration of the Oldham coupling 90 according to the fourth embodiment. FIGS. 22A to 22C are views showing a relationship between the Oldham coupling 90 and the torsion coil spring 80 when image formation is not underway. FIG. 22A is a view showing the Oldham coupling 90 from the rotational axis direction of the drum 62 when the cartridge B is mounted in main body A of the apparatus, FIG. 22B is a sectional view cut along an X-X section, and FIG. 22C is a partially enlarged view of the X sectional view, showing the vicinity of a groove 93*f* formed in the Oldham coupling 90. FIGS. 23A to 23C are views showing a relationship between the Oldham coupling 90 and the torsion coil spring 80 when image formation is underway. FIG. 23A is a view showing the Oldham coupling 90 from the rotational axis direction of the drum 62 during image formation, FIG. 23B is a sectional view cut along a Y-Y section, and FIG. 23C is a partially enlarged view of the Y sectional view, showing the vicinity of the groove 93*f* formed in the Oldham coupling 90.

Using FIGS. 21, 22, and 23, the configuration of the Oldham coupling 90 will be described. As shown in FIG. 21, the Oldham coupling 90 is constituted by a development input gear 91, an intermediate engagement portion 92, and a drive-side engagement portion 93. The development input gear 91 is engaged to a rotary shaft of the developing roller 32 as a driven portion for transmitting driving force to the developing roller 32. The drive-side engagement portion 93 is engaged to the drive shaft 19 provided in main body of the apparatus as a driving force receiving portion for receiving driving force from main body of the apparatus. The intermediate engagement portion 92 is an intermediate member that connects the development input gear 91 to the drive-side engagement portion 93 so that the development input gear 91 and the drive-side engagement portion 93 can be displaced relative to each other in the mounting direction in which the cartridge B is mounted in main body of the apparatus. The development input gear 91, the intermediate engagement portion 92, and the drive-side engagement portion 93 can be displaced relative to each other in the mounting direction of the cartridge B, i.e. in a direction intersecting a rotational axis direction of the Oldham coupling 90 (an orthogonal direction to the rotational axis direction in this embodiment). The drive-side engagement portion 93 is a part for receiving driving force from the drive source of the main body. The drive-side engagement portion 93 is capable of moving in an orthogonal direction to an axial direction of the developing roller 32. Further, three projections 93*a*, 93*b*, 93*c* are formed integrally with the drive-side engagement portion 93 so as to be engaged to the second drive shaft 19 (not shown) of main body A of the apparatus. A rib 91*a* is provided integrally with the development input gear 91 on a surface thereof facing the intermediate engagement portion 92, and a groove 92*a* is provided in a surface of the intermediate engagement portion 92 that faces the development input gear 91. The rib 91*a* and the groove 92*a* are engaged to each other to be capable of moving in the direction of an arrow H in FIG. 21. Further, a rib 93*e* is provided integrally with the drive-side engagement portion 93 on a surface thereof facing the intermediate engagement portion 92, and a groove 92*b* is provided in a surface of the intermediate engagement portion 92 that faces the drive-side engagement portion 93. The rib 93*e* and the groove 92*b* are engaged to each other to be capable of moving in the direction of an arrow I in FIG. 21. In this embodiment, the H direction and the I direction are substantially orthogonal. Hence, in the Oldham coupling 90, the development input gear 91 and the drive-side engagement portion 93 can move along the grooves 92*a*, 92*b* even when the second drive shaft 19 on main body A of the apparatus side and the rotary shaft of the developing roller 32 are not coaxial. Therefore, deviation between the axis of the second drive shaft 19 (not shown) provided in main body A of the apparatus and the axis of the development input gear 91 can be permitted within a movement range thereof along the grooves 92*a*, 92*b*, and as a result, driving force can be transmitted from main body A of the apparatus to the development input gear 91.

As shown in FIGS. 22A to 22C, the torsion coil spring 47 is attached to the boss 26*b* of the drive-side development side member 26 as biasing member for biasing the Oldham coupling 90. The coil 47*c* is hooked around the boss 26*b* such that the first arm 47*a* contacts the groove 93*f* in the drive-side engagement portion 93. Here, the groove 93*f* provided in the drive-side engagement portion 93 will be described. The drive-side engagement portion 93 includes a peripherally shaped portion that extends along a rotational axis direction outer side, and the groove 93*f* is formed in an annular shape in a surface of the peripherally shaped portion so as to extend in a circumferential direction of the drive-side engagement portion 93. More specifically, the groove 93*f* is configured such that when seen on a rotational axis direction cross-section, both edges thereof are provided on a peripheral surface of the drive-side engagement portion 93. Further, a distance between the two edges is set as the opening width F. As regards the rotational axis direction sectional shape of the groove 93*f*, similarly to the other embodiments, any shape can be used as long as the opening width F is wider than the wire diameter of the torsion coil spring 47 and the lubricant can accumulate in the groove interior. Further, the second arm 47*b* contacts the receiving portion 26*c*. Thus, the Oldham coupling 90 is biased in a direction heading toward the drum 62 so as to contact the hole 26*d* in the drive-side development side member 26. Accordingly, when the cartridge B is mounted in main body A of the apparatus, the position of the Oldham coupling 90 is fixed, and as a result, the Oldham coupling 90 and the second drive shaft (not shown) provided in main body A of the apparatus can be engaged more reliably.

Furthermore, as shown in FIGS. 23A to 23C, during image formation, the Oldham coupling 90 is aligned with the axis of the second drive shaft 19 (not shown) provided in main body A of the apparatus, and therefore the contact with the hole 26*d* in the drive-side development side member 26 is released. Likewise in this case, since the opening width F of the groove 93*f* is wider than the wire diameter of the first arm 47*a* of the torsion coil spring 47, the first arm 47*a* is unlikely to become detached from the groove 93*f*. Accordingly, the first arm 47*a* can follow the movement of the Oldham coupling 90 while remaining in contact with the groove 93*f* in the drive-side engagement portion 93. With this configuration, the Oldham coupling 90 can be biased directly by the torsion coil spring 47 such that the position of the Oldham coupling 90 is fixed. Therefore, in comparison with a conventional configuration in which a bearing is provided on the outer side of the drive-side engagement portion 93 and the bearing is biased by the torsion coil spring 47, a reduction in the number of components corresponding to the absence of the bearing can be achieved. Furthermore, since a bearing is not required, space can be saved inside the apparatus. Moreover, a contact position in which the torsion coil spring 47 contacts the Oldham coupling 90 during image formation can be limited.

Hence, the biasing member can be more reliably limited to a fixed position relative to the coupling member. Further, when the groove extending around the circumference of the coupling member is coated with lubricant, the lubricant can accumulate in the groove interior so as to exist between the coupling member and the biasing member at all times. The lubricant thus serves to reduce friction between the coupling member and the torsion coil spring 47, and as a result, an increase in the lifespan of the coupling member can be expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-240657, filed on Dec. 12, 2016 which is hereby incorporated by reference herein in their entirety.

What is claimed is:

1. A cartridge that can be mounted in and detached from a main body of an apparatus of an image forming apparatus, the main body of the apparatus including a drive shaft, the cartridge comprising:

a rotating member rotated by a driving force received from the main body of the apparatus;

a coupling member that includes a force receiving portion for receiving the driving force from the main body of the apparatus via the drive shaft, transmits the driving force to the rotating member by rotating, and is capable of moving relative to the rotating member; and a wire-shaped biasing member for biasing the coupling member, wherein the coupling member includes a groove that is contactable with the biasing member, and an opening width of the groove is wider than a wire diameter of the biasing member.

2. The cartridge according to claim 1, wherein lubricant accumulates in the groove.

3. The cartridge according to claim 1, wherein the groove is formed in an annular shape so as to extend in a circumferential direction of the coupling member, and has an arc-shaped cross-section in a rotational axis direction thereof.

4. The cartridge according to claim 1, wherein the groove is formed in an annular shape so as to extend in a circumferential direction of the coupling member, and tapers from a bottom toward an opening thereof.

5. The cartridge according to claim 1, wherein the coupling member includes an engagement portion that is engaged to the rotating member on an opposite side to the force receiving portion, and, between the engagement portion and the force receiving portion, includes a peripherally shaped portion having a peripheral surface that is coaxial with a rotational axis of the rotating member, and a tapered portion having a tapered surface that extends, while increasing in diameter, from an end of the peripherally shaped portion on the force receiving portion side to the force receiving portion side.

6. The cartridge according to claim 5, wherein the groove is formed in an annular shape between the peripherally shaped portion and the tapered portion so as to extend in a circumferential direction of the coupling member.

7. The cartridge according to claim 5, wherein the groove is formed in an annular shape in a surface of the tapered portion so as to extend in a circumferential direction of the coupling member.

8. The cartridge according to claim 6, wherein the force receiving portion is engaged to the drive shaft when the cartridge is in a predetermined mounting position in the main body of the apparatus, and the biasing member biases the coupling member such that the side thereof on which the force receiving portion is provided tilts toward a downstream side in a mounting direction in which the cartridge moves to the mounting position when the cartridge is mounted in the main body of the apparatus.

9. The cartridge according to claim 5, wherein the groove is formed in an annular shape in a surface of the peripherally shaped portion so as to extend in a circumferential direction of the coupling member.

10. The cartridge according to claim 1, wherein the coupling member includes the force receiving portion which is engaged to the drive shaft, an engagement portion that is engaged to the rotating member, and an intermediate engagement portion that connects the force receiving portion and the engagement portion to each other, the coupling member being rotated by the driving force, which is received from the drive shaft, so as to transmit the driving force to the rotating member, and the intermediate engagement portion connects the force receiving portion and the engagement portion to each other so that the force receiving portion and the engagement portion can be displaced relative to each other in a direction intersecting a rotational axis direction of the coupling member, or in other words a mounting direction in which the cartridge moves to a predetermined mounting position in the main body of the apparatus when the cartridge is mounted in the main body of the apparatus.

11. The cartridge according to claim 10, wherein the force receiving portion and the engagement portion respectively include ribs that are each engaged to a groove provided in the intermediate engagement portion.

12. The cartridge according to claim 10, wherein the coupling member includes the groove in an annular shape, which is provided in a surface of the force receiving portion so as to extend in a circumferential direction, and by an action of biasing force caused by the biasing member contacting the groove, the force receiving portion can slide in the mounting direction along a groove provided in the intermediate engagement portion.

13. The cartridge according to claim 6, wherein the biasing member biases the force receiving portion such that the force receiving portion is positioned on a downstream side of the engagement portion in a mounting direction when the cartridge is mounted in the main body of the apparatus.

14. The cartridge according to claim 10, wherein the force receiving portion and the engagement portion are connected to the intermediate engagement portion so as to be capable of moving in substantially orthogonal directions to each other.

15. The cartridge according to claim 1, wherein the rotating member is a photosensitive member.

16. The cartridge according to claim 1, wherein the biasing member is formed by bending metal wire into a coil shape.

17. The cartridge according to claim 1, wherein the rotating member is rotatable about a first rotational axis, and the coupling member is rotatable about a second rotational axis, and the coupling member is capable of moving relative to the rotating member between a first position and a second position in which an angle formed by the first rotational axis and the second rotational axis is larger than that in the first position, wherein the biasing member engages with the groove when the coupling member is positioned in the first position.

18. A cartridge detachably mountable to a main body of an image forming apparatus, the main body including a drive shaft, the cartridge comprising:

a rotating member rotatable about a first rotational axis;

a coupling member rotatable, with the rotating member, about a second rotational axis and movable relative to the rotating member between a first position and a second position different from the first position in a direction crossing the first rotational axis, the coupling member including a force receiving portion configured to engage with the drive shaft for receiving a driving force from the main body and an engaging portion engaging with an end portion of the rotating member in a direction of the first rotational axis, the coupling member including a tapered portion whose diameter becomes larger toward the force receiving portion and a columnar portion, wherein the force receiving portion, the tapered portion, the columnar portion, and the engaging portion are arranged in the order in a direction of the second rotational axis; and a torsion coil spring that includes an arm contacting the coupling member and urging the coupling member in a direction from the first position to the second position, wherein the coupling member includes a groove at a border between the tapered portion and the columnar portion in the direction of the second rotational axis, and with which the arm of the torsion coil spring engages when the coupling member is positioned in the first position.

19. The cartridge according to claim 18, wherein the groove is an annular groove formed on a peripheral surface of the coupling member.

20. The cartridge according to claim 18, wherein a lubricant is disposed in the groove.

21. The cartridge according to claim 18, wherein the coupling member at the second position is positioned downstream of the coupling member at the first position in a direction in which the cartridge is mounted in the main body.

22. The cartridge according to claim 18, wherein the coupling member is capable of being tilted with respect to the rotating member so that an angle formed by the first rotational axis and the second rotational axis in the second position is larger than that in the first position.

23. The cartridge according to claim 18, wherein the arm of the torsion coil spring extends in a tangential direction of a peripheral surface of the coupling member when the coupling member is positioned in the first position.

* * * * *